US009044364B2

(12) United States Patent
Dominick

(10) Patent No.: US 9,044,364 B2
(45) Date of Patent: Jun. 2, 2015

(54) PORTABLE HUMAN TRANSPORT SYSTEM

(71) Applicant: ERIPIO, LLC, Evansville, IN (US)

(72) Inventor: Damien H. Dominick, Clive, IA (US)

( * ) Notice: Subject to any disclaimer, the term of this patent is extended or adjusted under 35 U.S.C. 154(b) by 0 days.

(21) Appl. No.: 13/943,768

(22) Filed: Jul. 16, 2013

(65) Prior Publication Data

US 2014/0020183 A1 Jan. 23, 2014

Related U.S. Application Data

(60) Provisional application No. 61/672,743, filed on Jul. 17, 2012.

(51) Int. Cl.

| | |
|---|---|
| ***A61G 1/013*** | (2006.01) |
| ***A61G 1/02*** | (2006.01) |
| ***A61G 1/04*** | (2006.01) |
| ***A61G 1/044*** | (2006.01) |

(52) U.S. Cl.

CPC ..... *A61G 1/013* (2013.01); *A61G 1/0293* (2013.01); *A61G 1/04* (2013.01); *A61G 1/044* (2013.01); *A61G 2220/10* (2013.01)

(58) Field of Classification Search

CPC ..... A61G 1/013; A61G 1/0293; A61G 1/04; A61G 1/044; A61G 2220/10

USPC ..... 5/627, 625, 628; 2/108, 69.5, 69, 94

See application file for complete search history.

(56) References Cited

U.S. PATENT DOCUMENTS

| | | | |
|---|---|---|---|
| 4,534,075 | A | 8/1985 | Schnitzler |
| 4,679,260 | A | 7/1987 | Frettem |
| 5,381,936 | A | 1/1995 | Beery |
| 5,496,092 | A | 3/1996 | Williams |
| 5,699,568 | A | 12/1997 | Couldridge |
| 6,216,296 | B1 | 4/2001 | Carrasco |
| 7,155,764 | B2 | 1/2007 | Sawatzky |
| 7,168,110 | B2 | 1/2007 | Girard |
| 2003/0150059 | A1 | 8/2003 | Sawatzky |
| 2010/0237111 | A1 | 9/2010 | Mroczka |

*Primary Examiner* — Peter M Cuomo
*Assistant Examiner* — Brittany Wilson
(74) *Attorney, Agent, or Firm* — Baxam Law Group, LLC; Deanna L. Baxam

(57) ABSTRACT

A portable human transport system for use in field medical rescue operations comprising a fully collapsible litter element attached to one or more rescue harnesses via a choke braking system which minimizes unnecessary patient movement during transport. The transport system may be used by a single rescuer or by multiple rescuers.

17 Claims, 30 Drawing Sheets

PORTABLE HUMAN TRANSPORT SYSTEM

This application claims the benefit of U.S. Provisional Application Ser. No. 61/672,743, filed Jul. 17, 2012.

TECHNICAL FIELD OF THE INVENTION

The invention relates to a portable human transport system which may be used by a single rescuer or multiple rescuers for immobilizing and transporting a patient or casualty in a field emergency setting. The transport system may be used in circumstances where conventional emergency response vehicles and apparatus may be unavailable or impractical, such as in battlefield emergency field rescue operations or in emergency support and rescue of persons injured during outdoor wilderness activities in remote areas that are not accessible by medical transport vehicles.

The invention has an application for medical support in military field environments. Military field hospitals for the treatment of soldiers injured on the battlefield emerged in the fifteenth century, and the treatment of medical injuries in combat situations was referenced even earlier by Hippocrates, a physician of Greek medicine during the 5th century BC. In early military medical care, field medics would evacuate wounded from the battlefield to dressing stations just outside the zone of active combat for triage care, and if necessary later on to military field hospitals located well behind battle lines. Evacuation of this nature would generally involve use of a stretcher, litter or other rudimentary means of transport, usually carried by two or more people. Even though the methods of warfare have changed over centuries, the need for effective apparatus and means to transport wounded personnel has not changed, and the field stretcher remains an important element of equipment used in field medical service worldwide.

The invention also has applicability in the field of wilderness medical emergencies or injuries from outdoor athletic activities. Injuries that may occur during such activities may arise from slips, falls and other accidents to persons engaged in strenuous or wilderness activities such as hiking or mountain-climbing, including altitude sickness, heat exhaustion, hypothermia, lacerations, broken bones and sprains. Otherwise, persons may succumb to pre-existing medical conditions such as asthma, vertigo, diabetes and heart disease. The same qualities of durability, ruggedness, portability and the adaptability for use in demanding conditions and environments that are desirable for the use of field equipment in combat situations are also desirable for equipment used in the evacuation of persons injured while engaged in wilderness or sports activities, because such locations are not readily accessible by ambulances or vehicles which cannot travel over terrain without roads. The invention is also useful in fire and disaster rescue scenarios to recovery the wounded or corpses.

Field stretchers are often carried by one or more persons in the evacuation of mass casualties or individual wounded combatants. Specially trained military combat medics or rescuers in the civilian context are often called upon to render aid in remote, austere, or resource-deficient environments. Civilian rescuers may include wilderness first responders (WFR) or wilderness emergency medical technicians (WEMT) who have been trained to deliver a standard and professional medical response by Wilderness EMS Systems (WEMS) in wilderness areas. Examples of such service personnel in the United States include the National Ski Patrol and the National Park Service search-and-rescue (SAR) teams, as well as local search and rescue agencies.

Field stretchers may be categorized into a few major types. Most are conventionally either disaster stretchers, which are not typically foldable but are usually lightweight, stackable and made of easily washable material. Normalized stretchers may be foldable units that can be carried by two or more persons. Scoop stretchers may be detachable longitudinally to allow a patient to be loaded on one longitudinal section, which may then be connected to the other section. Basket stretchers, another type, have a frame formed of a durable hard material that cradles the injured person, and are typically not flexible or collapsible in the manner of normalized stretchers. In more conventional non-field applications, stretchers typically have limited folding capacity but may be equipped with other features, for example to allow tethering inside an ambulance, or wheels for ease of movement.

In wilderness or combat conditions, the injured patient must first be stabilized so that any additional movement will not exacerbate the existing injury. In order to do this, it is desirable to have a means for immobilizing the patient prior to moving them to avoid causing further injury before they are moved any distance. After the patient is immobilized and given any immediate medical attention needed to stabilize vital signs as much as possible, the patient is lifted by means of a transport system and transported to the location of further treatment such as a field hospital or medical center.

BACKGROUND ART

U.S. Pat. No. 4,534,075 to Schnitzler describes an ambulance stretcher that has side rails, safety belts that run over the shoulders and across the stretcher, and a "fixing belt" that retards movement of the stretcher when force is applied to shift it out of position, e.g. during braking, while it is being used in a vehicle. The stretcher also adjusts in height by virtue of wheels. U.S. Pat. No. 7,155,764 to Sawatsky describes a split-apart basket stretcher having side poles with removable handles. U.S. Pat. No. 5,699,568 to Couldridge discloses a stretcher with multi-layered side panels that can be folded over the patient to form a drag bag. The sides of the stretcher are supported by poles that are not telescoping or otherwise adjustable in length to render them more portable. U.S. Pat. No. 4,679,260 to Frettem discloses a flexible stretcher with tubular elements that are friction fit together to form the stretcher frame. U.S. Pat. No. 7,168,110 to Girard discloses a Stokes basket-type lifting mechanism and a three-point harness used to secure a patient to a stretcher. Published U.S. National Stage Application 2003/0150059 depicts a carabiner fastener arrangement for tubular framed basket stretchers to permit lifting.

A need identified in the area of field emergency rescue medicine is for a transport system that can be used by an unaided single rescuer to secure, physically stabilize and carry a non-ambulatory person. There is a further need for a multipurpose transport system that is fully portable and may be deployed in a field or wilderness setting by a single rescuer or by multiple rescuers for the transport of non-ambulatory persons that has a litter means equipped with rigid, telescoping side poles forming a frame for support and lifting; the side poles, frame and entire litter means also being fully collapsible for transport and storage; and which further has a braking means to prevent swaying or other undesirable movement of the non-ambulatory person's body during transport. Such a system has not been disclosed or suggested in the prior art. Nor is there taught or suggested in the prior art a transport system of this nature that is also multi-functional and capable of being used in various alternate ways to support or rescue non-ambulatory and injured persons, for example by providing crutch or ambulatory support means, providing a tent shelter, casualty body bag, or to provide signaling for emergency assistance. These deficiencies in the prior art are met by the present invention, which provides a mobile rescue transport system that is versatile and may be operated by one rescuer or multiple rescuers in a number of ways while providing improved stability to a patient or other person requiring transport in an emergency field setting.

SUMMARY OF THE INVENTION

As used herein, the terms "patient" or "casualty" shall mean a wounded or injured person or other non-ambulatory person, casualty or corpse requiring transport from one location to another in a field emergency or wilderness rescue setting.

The present invention provides an efficient, portable field transport system that can be used by one or more rescuers to carry, protect and support patients until they can be brought to an established medical treatment location. In this regard, the system comprises a foldable litter element that may be reversibly fitted with rigid telescoping poles at the sides, and optionally poles at the ends thereof; these poles providing a rigid frame for secure transport, weight-bearing and even distribution of the patient's body weight, and also being amenable to field use by virtue of their fully collapsible, telescoping configuration. The system additionally comprises a three point rescue harness means to immobilize a patient for transport by others, and in particular for a single rescuer to transport a patient; and a choke braking system that disrupts the arc of movement of the stretcher so as to reduce the impact of additional movement on the patient being transported, and to reduce or minimize unnecessary movement or motion such as shifting, slippage or swaying of the stretcher, even if it is being transported by a single rescuer. In other embodiments, the poles comprise crutch or walking stick elements that provide partial stabilization and load-bearing relief to a wounded person who is able to walk with the assistance of some support. The system according to the invention also provides a means to shelter a wounded person or casualty in the field or remote location. The system may be collapsed and folded to make it fully transportable, optionally in a hands-free way, by a single rescuer in a field setting. When loaded with a casualty, the system may also be transported hands-free by the rescuer who can then use his/her hands to perform other tasks. Alternatively, the method provides for transport of the stretcher and patient by multiple rescuers. In this respect, one end of the litter element is attached to the rear of a rescue harness worn by a first rescuer; the opposite end of the litter element is attached to the front of a rescue harness worn by a second rescuer; and the attachment of each opposing end of the litter element to the respective rescue harness is adjusted to elevate the litter element up to about waist high between the two rescuers. Both rescuers can then forward in a desired direction to transport the patient.

In another aspect, the present invention provides a method of immobilizing and transporting a patient or casualty which comprises placing the body of the patient on a stretcher element and securing the patient using a harness and braking mechanism to enable transport of the patient by a single rescuer.

The invention also provides a method of transporting an injured person by a single rescuer comprising seating the casualty body, in a cradle formed by the folded litter element, facing toward or away from the rescuer's back.

In another embodiment of the invention, the portable system of the invention may additionally be utilized without the at least one pair of poles to provide a soft drag bag for transporting a casualty where the use of poles is impracticable. In yet another embodiment, the portable human transport system may be configured for aerial lift by the attachment of a lift assembly.

DESCRIPTION OF CERTAIN EMBODIMENTS OF THE INVENTION

Figure 1:
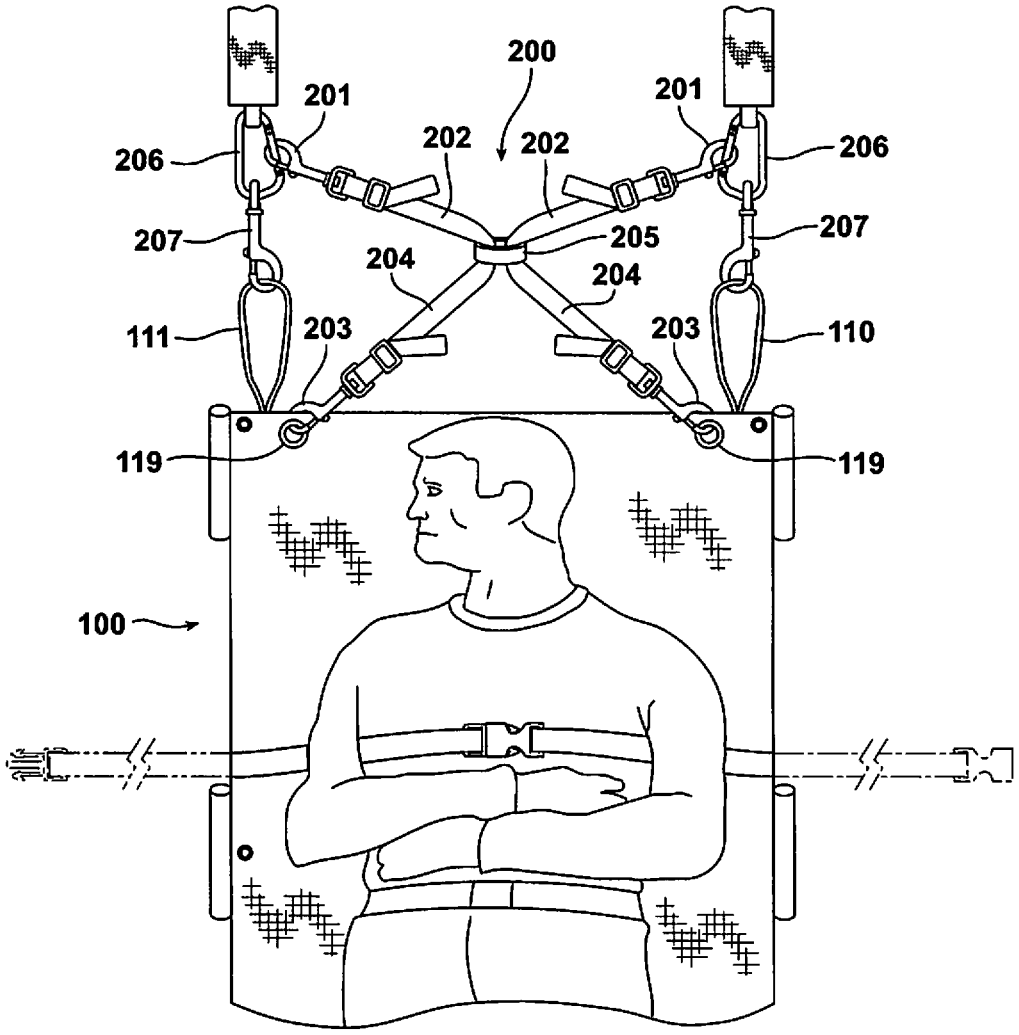
FIG. 1 is a view of the respective engagement of the rescue harness (worn by a single rescuer, not shown) and the choke braking system of the invention with the litter element while a patient is being transported using the system of the invention.

The portable human transport system operates in one aspect as a field stretcher which may optionally be for "single-carry" of an injured person or casualty. In this respect, the system may be strapped at one end to the back of a single rescuer wearing a rescue harness assembly, with the upper body of the patient harnessed to a litter or stretcher element. In this embodiment, the unattached, opposing end of the litter bearing the patient's lower body and extremities are disposed at an angle to the ground and obliquely in relation to the rescue harness assembly being worn by the rescuer. The system may also be configured for transport by multiple persons. For example, in a "two-carry" configuration, two rescuers, each wearing a rescue harness, transport the patient suspended in a relatively horizontal, supine position between them upon the litter element. In this embodiment, the patient is transported between the rescuers, without dragging, at a height that is no lower than about the waist height of the rescuers.

In other embodiments, the portable human transport system may be used to transport a seated patient by configuring the elements to form a fireman's cradle or seat for partially upright transport of a casualty.

In yet other embodiments, the invention provides a temporary emergency covering or shelter for a person awaiting transport or who is otherwise required to be laid in a supine position for the purpose of administering first aid. The shelter may also temporarily house casualties until recovery is possible. The transport system of the invention is collapsible and foldable and may be broken down and folded for storage or to be carried by rescuers when not in use. The stored unit may be folded and carried by hand as a roll or in a duffel bag. Alternatively, it may be strapped to the bearer's person or suspended from the shoulders like a ruck sack.

The system comprises a frame for supporting a litter element, the frame comprising telescoping support poles that may be used interchangeably as crutches or support poles connected to the edges of a flexible litter element. Optionally, transverse, horizontal stabilizer bars may be used with the telescoping poles to form the frame. The litter element may in certain embodiments be a single panel or be multiple panels adjacently located and connected one to the other. The litter performs the function of supporting and/or shielding the body of the person being transported. The system further comprises a rescue harness means, a choke braking element, and folding means to secure the system for transport.

The litter element, in an embodiment, is removably attached to a three-point rescue harness for securing the body of a person on the stretcher. The harness includes harness straps, each having as elements thereof a front harness strap portion which is in corresponding communication with a rear harness strap portion. Each rear harness strap portion is fitted at least one end thereof with harness loops that are attached by fastener means to the choke brake system and to the carry loops of the litter element. The rear harness strap portion may be fitted with one or more padded areas to protect and provide comfort to the shoulders of the wearer. The free, lead ends of the rear harness strap portions that are not secured to the litter edge loops pass over the shoulders of the rescue personnel and may attach, via fasteners, to transversely positioned chest and/or waist straps that encircle the rescue personnel's upper body. The lead ends may be equipped with adjustable connectors that allow the overall length of the harness straps to be adjusted to the wearer's body dimensions. The rear harness strap portions correspond to front harness strap portions that are attached to the chest or waist straps. Each of the front harness strap portions includes a series of vertically aligned openings corresponding to the changes in length of the corresponding rear harness strap portion.

The harness loops further provide openings that can accommodate, for example, a lanyard for IV or other medical tubing, lead wires for electrocardiographic measurements or cords for a power source connected to a wearable medical pump. The rescue harness may be connected at one end to the litter bearing the patient and may be further connected to a choke braking system which stabilizes the litter while it is being transported. The choke braking system, in its operation, interrupts the natural arc of motion through which a suspended object, in this case the litter element, would otherwise move in unimpeded range of motion. The braking system of the invention comprises a bezel ring for accommodating a number of adjustable straps. The straps are passed through the bezel ring and connected at one end to the grommets located near the edge of the topmost litter panel (or to the single litter panel if the litter element is not made up of folded panels). The other end of each bezel strap is connected at the other end to the corresponding harness loop at the end of the rear harness strap that is removably fastened to a litter panel so as to permit lifting, pulling or dragging of the litter. In operation, as the litter is being moved, the bezel ring moves backwards or forwards in dynamic response to the drag exerted on the bezel straps by the lateral sway of the litter. The ring exerts a counter pressure that shortens the range of motion of the bezel straps, thereby minimizing the undesirable sideways movement of the litter element.

Figure 1A:
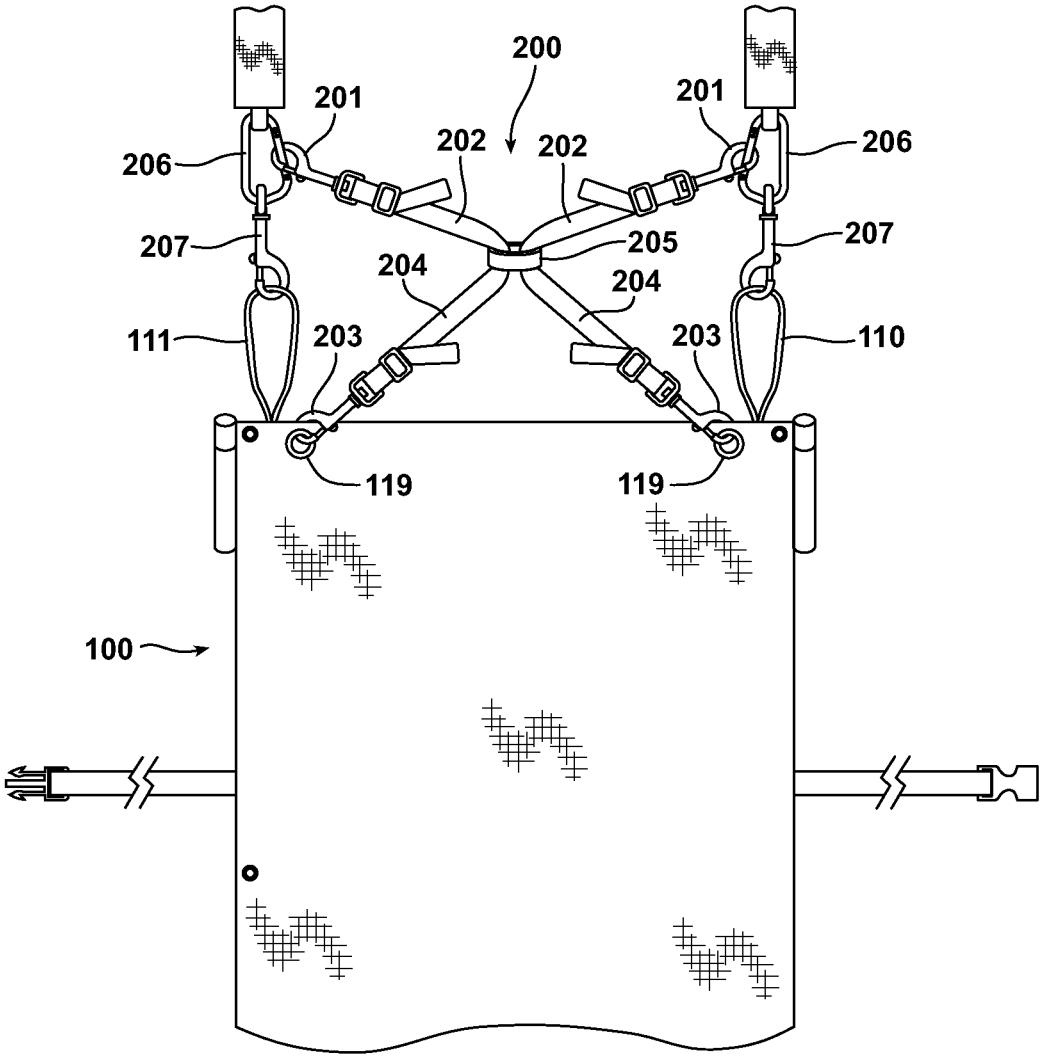
FIG. 1A is a planar view of the rescue harness, choke brake and litter elements cooperatively engaged.
Figure 1B:
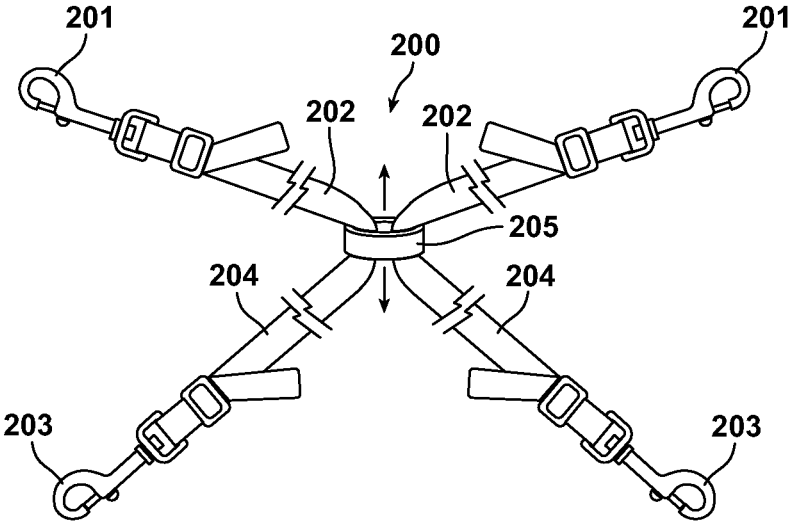
FIG. 1B is a planar view of the choke brake system.
Figure 1C:
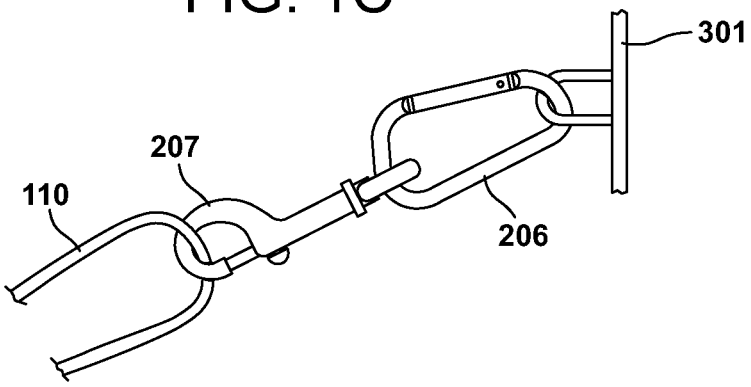
FIG. 1C is a representation of the hook and carabiner assembly used in the invention.
Figure 3:
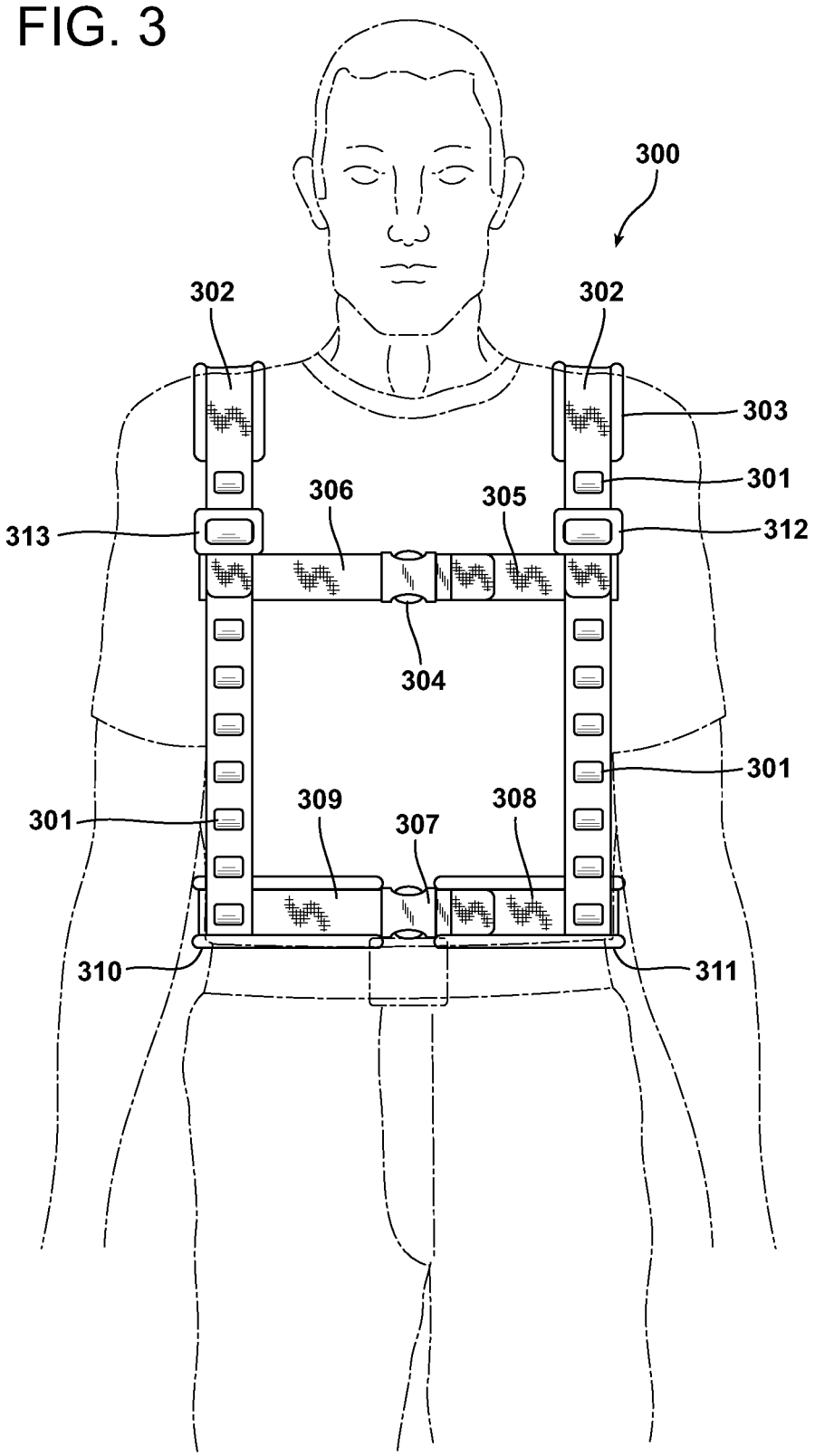
FIG. 3 is a frontal view of the rescue harness of the invention as worn by rescue personnel.
Figure 4:
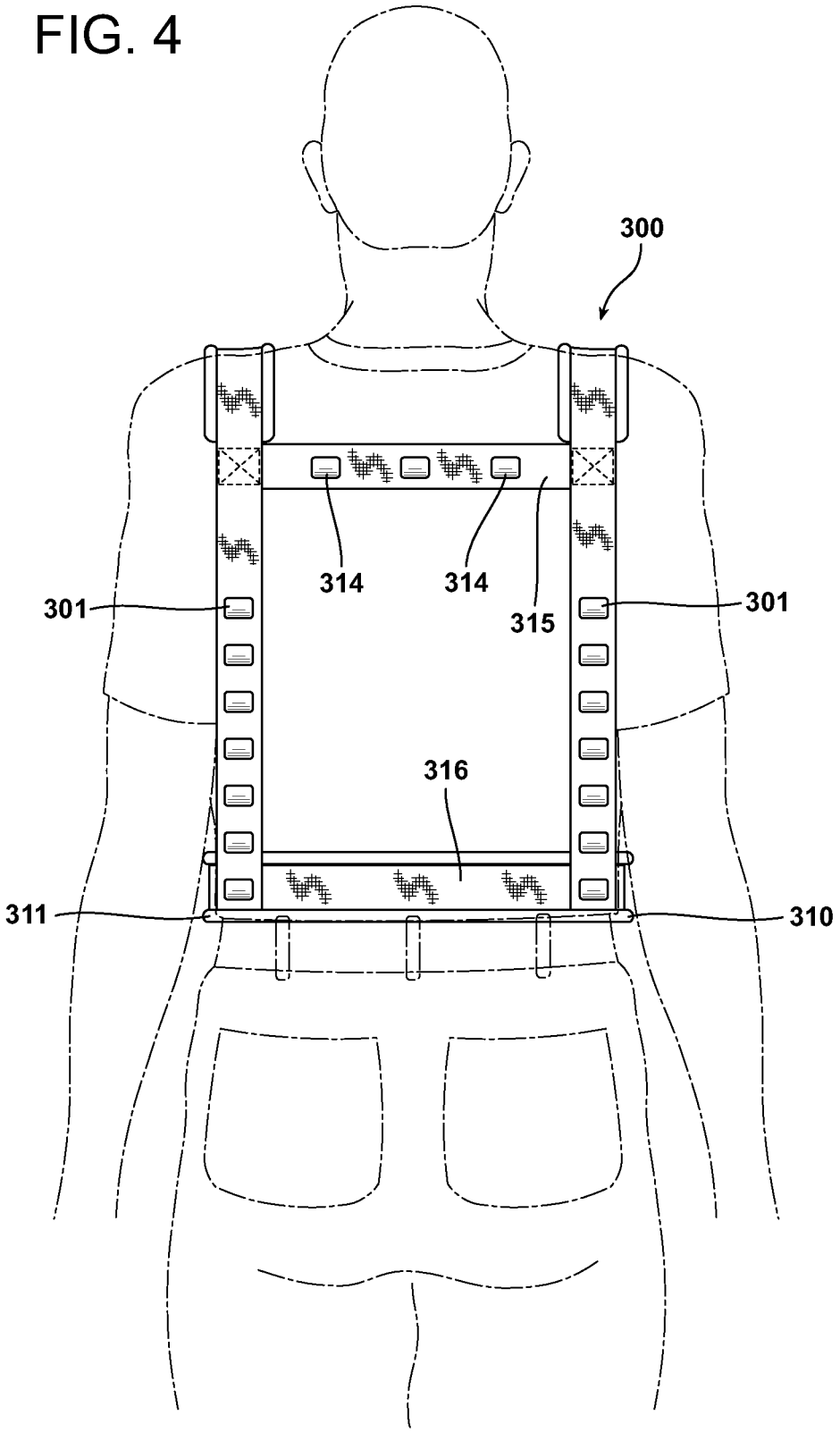
FIG. 4 is a rear view of the rescue harness of the invention as worn by rescue personnel.

According to the embodiment shown in FIGS. 1 and 1A, the invention comprises a litter panel 100 to which is attached a choke brake system 200. The choke brake is utilized to arrest forward and rear oscillation and movement of the portable transport system when it is in the harness rescue carry configuration. The choke brake comprises, for example, two webbed nylon straps passed through a small diameter metal bezel ring. The end of each strap passes through a snap hook assembly and then back through a non-slip buckle to allow for length adjustment of each strap. As exemplified in FIG. 1A, the choke brake system 200 is attached to loops 110 and to grommets 119 positioned near the edge of the litter 100. The brake system is comprised of adjustable straps that attach to the litter by means of hooks or carabiners. A carabiner is a metal loop with a spring loaded gate used to quickly and reversibly connect components of a system. As shown in FIGS. 1 and 1A, one end of each strap 202 is attached to a carabiner 201 that attaches the brake system to harness hooks 206, which are connected to loops 301 on the rescue harness 300 (FIGS. 3 and 4). The harness hooks 206 also connect to the loops 110, 111 of the litter by means of carabiners 207. As seen in FIG. 1B, the straps 202 and 204 are fitted with buckles that allow the straps to be lengthened or shortened as needed to adjust the stability of the brake system and minimize swaying of the litter as it is being transported. According to FIG. 10, carry loop 110 also attaches to the rescue harness via carabiner 207 attached to hook 206. The same type of attachment is used for the opposedly placed carry loop at the same end of the litter.

In configuration for use, each strap of the choke brake system is attached to the litter by grommets located on the left and right sides of the uppermost panel of the litter element. The brake is then positioned between the litter and the rescue harness and co-planar with the attachment means for the harness connection system (FIGS. 1, 1A). The individual straps 202 connect between the edge of the litter and the rescue harness and do not cross each other. Once connected, the straps are positioned and pulled tight to create constant tension on the sides of the metal rings of the harness attachment means. This constant tension creates a wall of tension that arrests forward and backward motion of the litter during hands-free, harnessed transportation of a casualty. The choke brake system may be used at either end of the litter or at both ends (for example with two rescuers carrying) and in this latter respect the brake systems work in tandem. The means and methods for attachment are the same whether the choke brake system is used to attach the litter to the harness in the front-carry or rear-carry positions.

Figure 2:
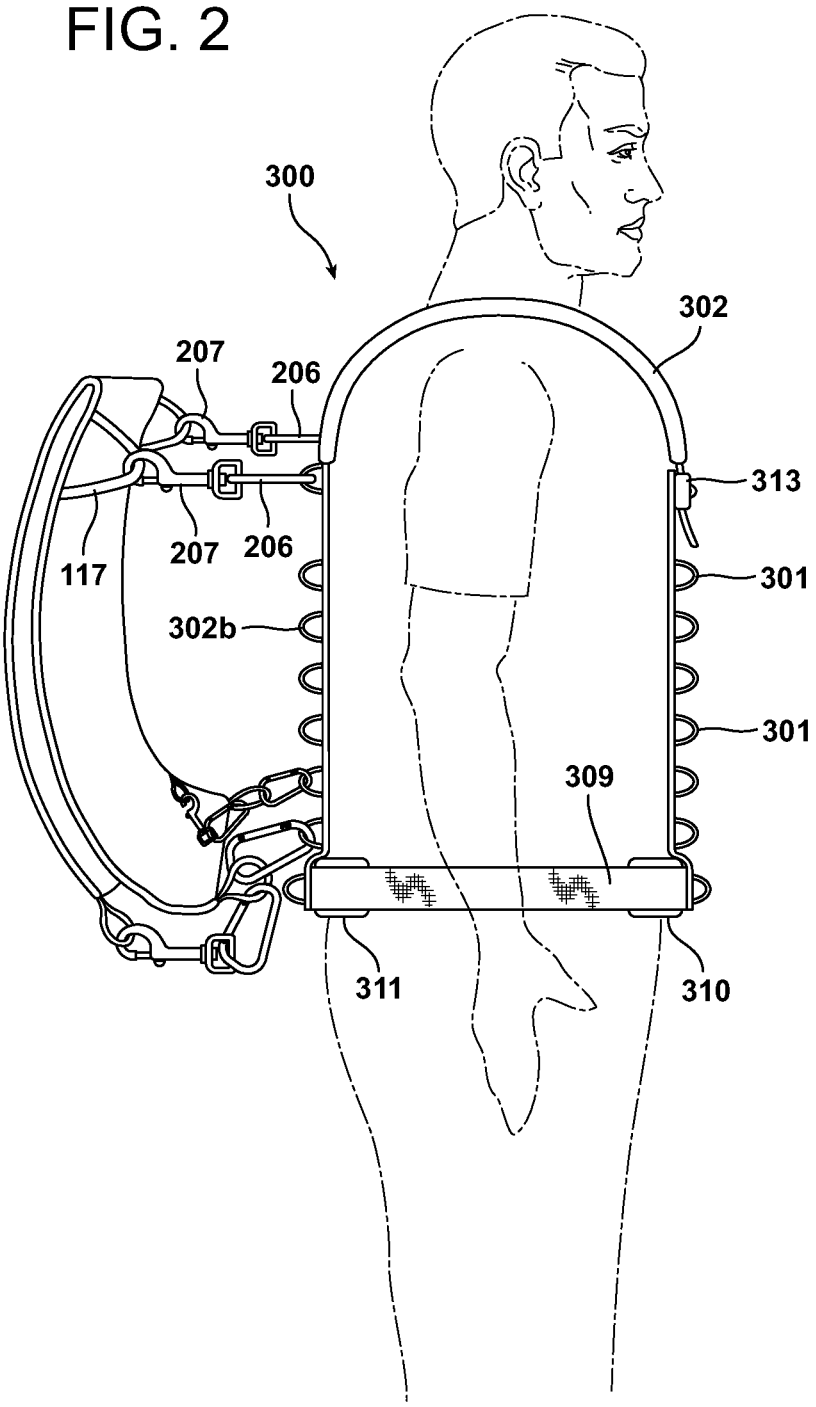
FIG. 2 is a side view of an embodiment of the transport system of the invention as it may be worn by rescue personnel to carry an injured person on the rescuer's back.

The rescue harness as shown in one embodiment 300 in FIG. 2, is fashioned as a rescue cradle seat. The cradle seat can be used to transport casualties by various rescue personnel in confined quarters such as in hallways with corners and doors, or up or down stairwells. The cradle is formed by taking the litter panel in its long-folded configuration and folding it in half inwardly upon itself, then attaching the folded panel to the harness connections to form a seat. The cradle is worn over the shoulders and torso of a rescuer to evenly distribute load bearing and enable free range of movement while a casualty is being transported or when the rescuer is moving about in the rescue zone. Generally, the harness connection means is comprised of one or more pairs of hingedly attached carabiner hooks attached to snap hooks, which are the typical means for attaching the carabiner hook fastener. The carabiner hook may be opened or closed by operation of a lever that is manually operated. In this way, the harness is attached to the carry cradle directly across from the front or rear rescue harness loops.

As further shown in FIG. 2, the litter 100 (single or multiple panels) is folded to form the cradle seat. To connect the rescue harness 300 to the litter element 100, the snap hooks 206 are clipped to loops 302*b* on the left and right side of the harness, facing the front or the back of the rescuer, and the carabiners 207 (or other hook fastening means) attached to the carry loops 117 of the folded litter element. In the folded cradle position, the heavy duty nylon carry loops 117 are attached to the sides near the top of the rescue harness 300, for example near the shoulder pads, and fasteners at the lower region on each side of the rescue harness are also passed through a pair of carry loops positioned below the top loops in about the waist area of harness 300. These upper and lower attachments form the seat area for the rescue cradle seat. The back support system of the cradle is formed from the folded litter panel. When folded in this manner, a casualty can be seated facing forward ("piggy-back" fashion) or facing outward, with the load distributed evenly across the back of the rescuer. In various embodiments, all the components of the system may also be folded and stored as a roll to which a sling may be attached or otherwise folded using the casualty restraint straps, tent cords, lift straps or tie lines for carrying purposes using the hook configurations shown in FIG. 2. The exterior of the roll, which is in part formed from an outermost exposed layer of litter panel, may be further equipped with attached pockets, clips and pouches to secure various elements of the mobile transport system. For example, pockets may be attached to hold different types of spikes and base caps, tent cords, the parts of the choke braking system and additional accessories such as mosquito netting. Clips for attaching other useful wilderness implements and tools may also be included.

The portable human transport system is built to incorporate the use of one or more personal harnesses. The harness contemplated by the invention is a universal, H-type shoulder harness which comprises a set of padded shoulder straps that extend downward from the shoulder blades and down the front torso and back of the wearer. Typically, the shoulder straps may be of a webbed nylon with a padded area closest to the body for comfort and may connect to a waist band that is also padded. According to FIG. 3, padded straps 302 fit over the shoulders, and are elongated in the back down to the region of the rescuer's waist and in the front down the chest area to the waist belt 309, 316. The belt has ends that may be attached by a closure means 307 and adjusted to fit securely around the waist area. The belt may be made of a sturdy webbing material with padded areas 310, 311 to alleviate rubbing, chafing or load stress. The straps 302 pass through non-slip buckles 312, 313 which allow for adjustment of the strap length to the dimensions of the wearer. Like the belt, the straps 302 may also be made of a durable webbing material that may also include padding in the shoulder regions. Padding 303, 310 and 311 may be constructed, for example, of a foam-like material that is durable, breathable and slip resistant. Evenly spaced loops 301 on the front area and 302*b* on the back area 3 of the harness allow attachment of the folded litter and for varying the height of the litter in relation to the rescuer or the length of the casualty's body. The loops 301, 302*b* also function as attachments for adaptation of the transport system to a totally hands-free carrying position so that the one or more rescuer's hands are free to accomplish other tasks. The loops 301, 302*b* further serve as points of attachment for tools or miscellaneous supplies such as lanyards for IV tubing, clips, keys and small tools. For example, an intravenous supply can be attached for delivery to a patient without the need for additional rescue personnel.

The harness is in part stabilized by adjustable, horizontal upper back and chest straps 305, 306, 315. As further shown in FIGS. 3 and 4, the harness 300 is fastened by closure means 304 that attaches upper harness strap portions 305, 306, which are contiguous with or attached to rear upper harness strap portion 315. The closure means 307 attaches front harness belt portions 308, 309, which are contiguous with rear harness belt portion 316. The closure means may be any closure means recognized as useful for rapid opening and closing with load bearing capacity, according to one of ordinary skill. Preferably, the closure means is a quick release buckle and tensioner apparatus made of a lightweight material such as plastic.

Figure 5:
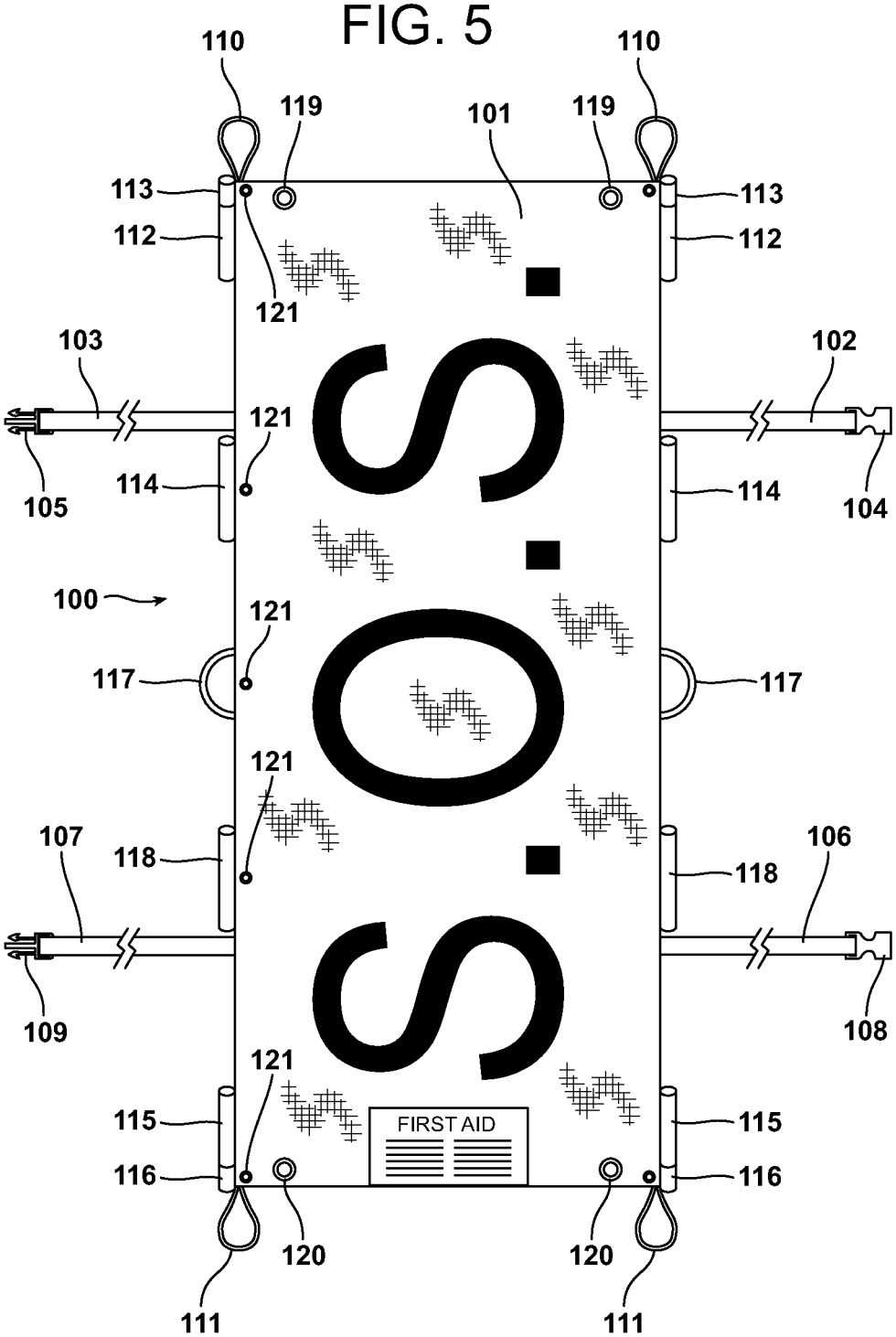
FIG. 5 is a planar, bird's eye view of the litter element of the transport system showing its use as a signaling device to rescue personnel overhead.

With respect to the litter or field stretcher configurations of the portable transport system, the litter 100 may be configured in several ways to accommodate removable stabilizing elements such as drag poles and transverse poles. In the embodiment of FIG. 5, the litter element 100 is fitted with sleeves 112, 114, 115 and 118 for receiving insertable, telescoping drag poles. Upper and lower sleeves 112 and 115 may optionally have a reinforced area at the end of the sleeve (elements 113, 116 respectively) to strengthen and stabilize the sleeve opening making it easier for the telescoping drag poles to be inserted. Edge carry loops 110 and 111 at the corners of the litter element and center carry loops 117 allow the litter to be hand carried or these loops can be attached to the rescue harness or to a lift mechanism to allow the litter bearing the casualty to be raised by helicopter. Carry loops 110, 111, 117 may also support other field shelter configurations of the system, for example when it is used as a tent.

The litter element may be comprised of at least one or multiple, adjacently placed, litter panels which fold in relationship one to the other. In one such preferred embodiment, the litter element comprises a single, stacked panel of layered fabrics folded to form a center panel that is contiguously formed with and flanked by two end panels connected to the center panel along the fold lines. Either the center panel or one of the end panels may be used as the primary transport base of the stretcher, in which case the other two elements may be folded under or over the transport base. Carry loops may be affixed to the corners of the center or end panels such that they may be used to lift the stretcher. The carry loops may be constructed from heavy duty nylon fabric or rope. In addition, strap loops may be affixed at various intervals through which casualty restraint straps may be passed to wrap over and be secured around the patient's body.

The fold lines along the lengthwise sides of the center panel and the outer edges of the end panels are each fashioned with a channel to accommodate one of the telescoping drag poles, or alternatively tabs are affixed to the fold line at opposing ends to create pole sleeves through which the poles may be slid into place. Corresponding male and female snaps may be opposedly attached to the corners and edges of the panels to enable two panels to be folded facing each other and secured together. There are additionally positioned at least one pair of parallel, spaced edge loops at either end of the litter, the presence of which makes it possible to attach the rescue harness element to the litter at one end or the other. In addition to these loops, one or all the panels may include a pair of parallel, spaced grommets at one or both of the narrower ends thereof.

With respect to the size of the litter element, the dimensions of each panel are selected to be of sufficient length and width to provide a litter that can accommodate various body sizes, with each panel being of approximately equivalent dimensions having the length greater than the width. As previously mentioned, the litter element itself may be composed from one or more layers of fabric having different characteristics that add to the functional suitability of the transport system for various applications, or any combination thereof. Each panel may further be comprised of layers of fabrics selected from materials that are porous, breathable, washable, insulating and reflective fabrics, or combinations thereof. For example, the outermost layers of the end panels in relation to the casualty's body may be made of camouflage print fabric or a reflective material that serves the purpose of signaling search and rescue teams and military transport pickups. Examples of suitable materials may be selected from CORDURA® durable, high-tenacity fiber fabric, nylon, canvas, nylon, polyester, TEFLON® nonstick polytetrafluoroethylene-coated fabric, polyamides, plastic, rubber, or combinations of these. For example, a durable fabric such canvas may be combined with other fabrics that may optionally be specifically colored or coated with a functional coating such as paint or dye, or with layers that possess waterproofing properties, or with thermal layers designed to enhance warming or cooling. In certain embodiments, the litter may be constructed of upper layers of CORDURA® durable, hiqh-tenacity fiber fabric and an under-paneling of canvas that is sturdy, resistant and less expensive. Other properties common to materials used in outdoor exposure or rescue conditions may also be contemplated. An external layer of the litter element may also be printed or otherwise affixed with graphics, text, emergency messaging, instructions, logos or brand information. FIG.5 shows an embodiment of the invention with an upper panel 101 which may be imprinted with an "SOS" signal which can be seen from overhead, as well as first aid instructions. The litter element may be formed from a single panel that includes multiple layers folded into panels, or it may be formed from separate panels that are sewn together and folded at the seams to form the litter element 100 configured for transport purposes. The outer edges of each panel may be sewn, glued or bonded to be stable and durable.

In one preferred embodiment, the litter element is formed from a single 90 × 90 inch (15 square feet) panel made of two layers of CORDURA® durable, high-tenacity fiber fabric, one in military fatigue green and the other colored blaze orange. This large square panel is folded, for example in accordion-like (Z-fold) fashion, and fastened on itself to form a 90 × 30 inch litter element. This rectangular shape is formed from folding of the square panel to form top, middle and lower panels. This can be achieved because the configuration of each panel includes a series of straps and fasteners that are positioned so that when correctly fastened, the precise, desired configuration of folded panels is obtained. The upper and lower panels are identical in size and configuration, thus enabling either end of the panels, when folded, to serve as the head or tail of the litter element. This allows the portable transport system to be oriented in either direction to accommodate a casualty. The layers may also be constructed of different materials.

Folded litter element 100 is bound from the underside and across the outermost layer on which the casualty is laid by casualty restraint strap portions 102, 103, 106, 107. These casualty restraint straps may be adjusted in length to secure the casualty and fastened by fastener means 104, 105, 108 and 109. As further shown in FIG. 6B, the casualty restraint strap portions 103, 107 may be permanently attached to the litter panels or may be affixed by being passed through loops 125, 126 located on the external face of the lower side of the litter element.

Figure 6:
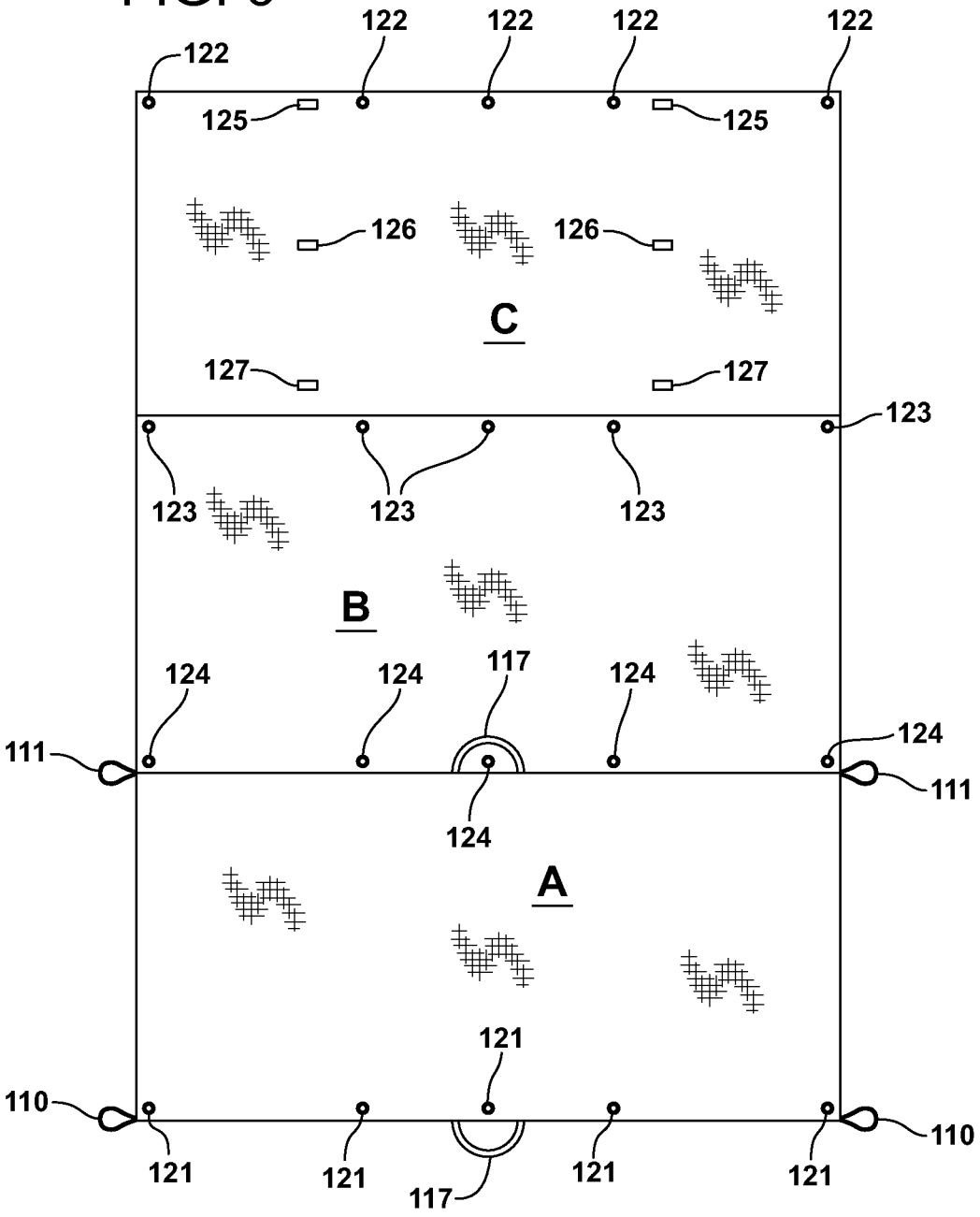
FIG. 6 is a planar view of the litter element according to the invention showing unfolded panels.
Figure 6A:
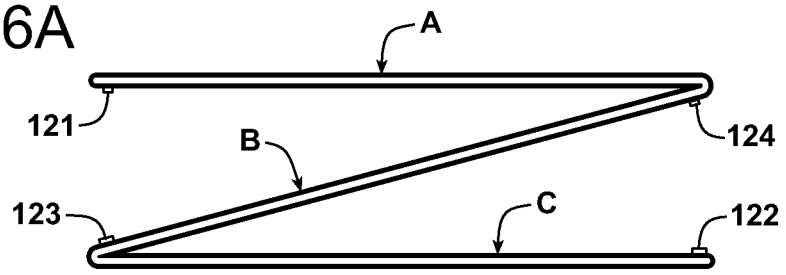
FIG. 6A shows the direction of folding of the litter panels to secure the litter element for a transport operation.
Figure 6B:
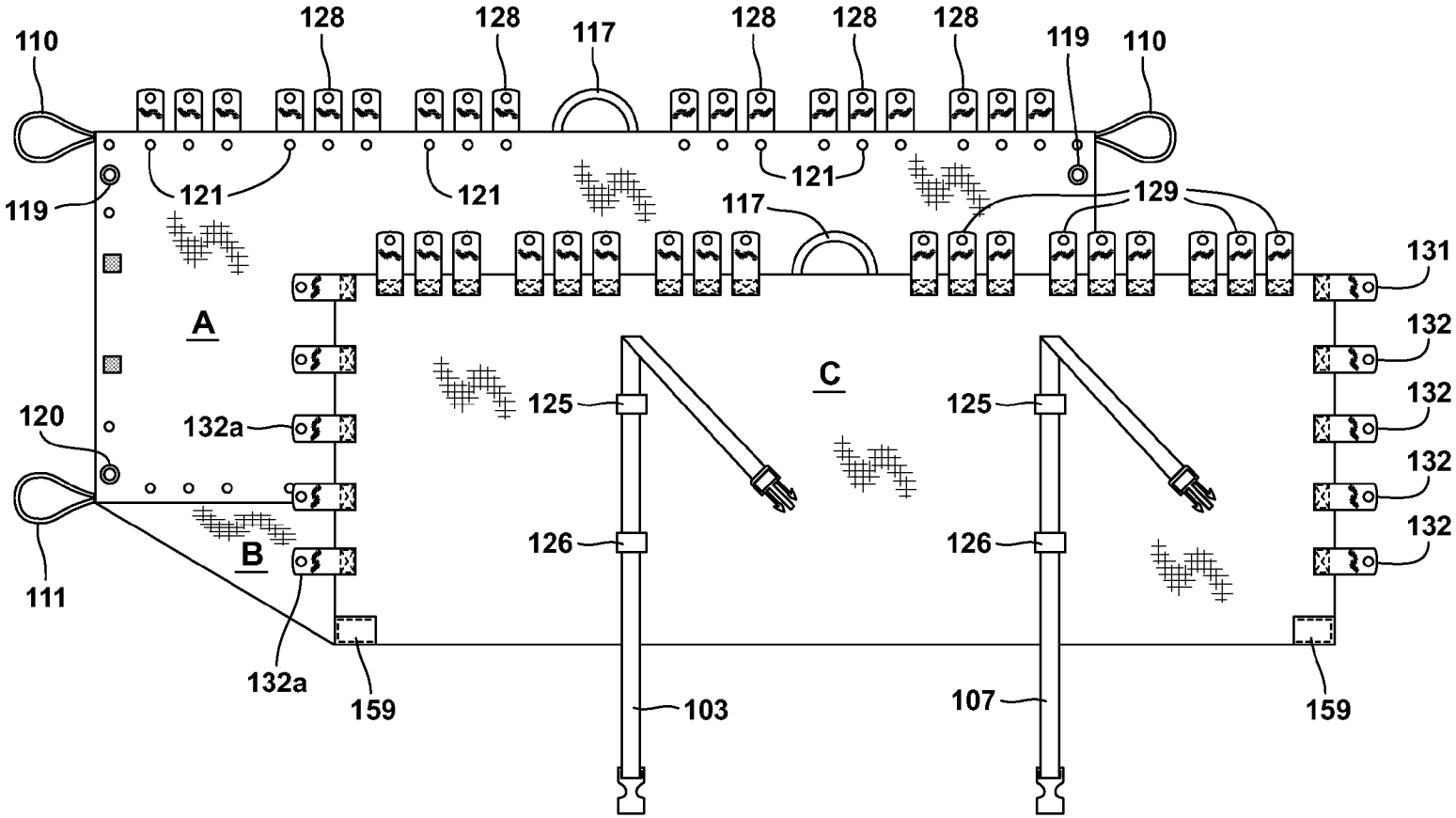
FIG. 6B is a perspective view of a partially folded litter panel having pole restraint straps along the edges and stabilizer bar restraint straps at the head and tail ends of the litter.

As shown in FIGS. 5 and 6, litter element 100 may include grommets 119 and 120 as attachments for the choke brake system. The grommets may also be used to affix carry hooks, cords, spikes or pegs depending on the immediate intended use of the portable transport system. Also included at the head and tail end of the litter element and located outwardly and near the corners in relation to grommets 119, 120 are male pull dot snap ends 121 for connection to stabilizer bar restraint straps (see FIGS. 6A and 7C) that may optionally be attached to the head or tail ends of the litter element. The head and tail ends of the litter element may additionally, and in some embodiments alternatively, include one or more attachment means, for example VELCRO® reclosable hook and loop fastener patches, for attaching the stabilizer bar restraint straps.

In another embodiment of the invention as shown in FIGS. 6B, 6D, 7A and 7C, running the length of the folded litter element and affixed between the panels are a series of evenly spaced pole restraint straps 128, 129. The straps 128, 129 form a closure means which provide an alternative to pole sleeves 112, 114, 115 and 118 shown in FIG. 5. According to FIG. 6B, a side edge of panel A of the litter element includes straps 128 that are sewn between the layers of the litter panel. A series of straps 129 is sewn into a side edge of panel C. Each of the unattached ends of straps 128, 129 has a female pull dot snap (157 shown in FIG. 7A) which corresponds to a male pull dot snap 121 that is affixed to the litter panel A. Panel C is similarly configured with female pull dot snaps 157 that correspond to male snaps 122 (shown in FIG. 6). When snaps 121 or 122 are fastened to snaps 157, the straps form loops that are sized to accommodate the poles 150. The straps are folded to form loops through which litter poles 150 may be inserted to form a carry frame for the litter element 100. At the head and tail ends of the litter element 100 may also be located tabs 132 and 132*a* respectively which may be folded over and attached by means of snaps to form loops for stabilizing restraint bars located at the head and tail of the litter element. Generally, the loops function to retain the telescoping side poles and the head and tail end stabilizer restraint bars, and in the case of the side loops, further to secure the trifold panels of the litter and travois configurations.

The straps 128, 129, 132, 132a may be formed of durable load-bearing material, such as a webbed material, nylon, CORDURA® durable, high-tenacity fiber fabric, any materials suitable for construction of the litter panels, or other lightweight, flexible, load-bearing materials.

Figure 7:
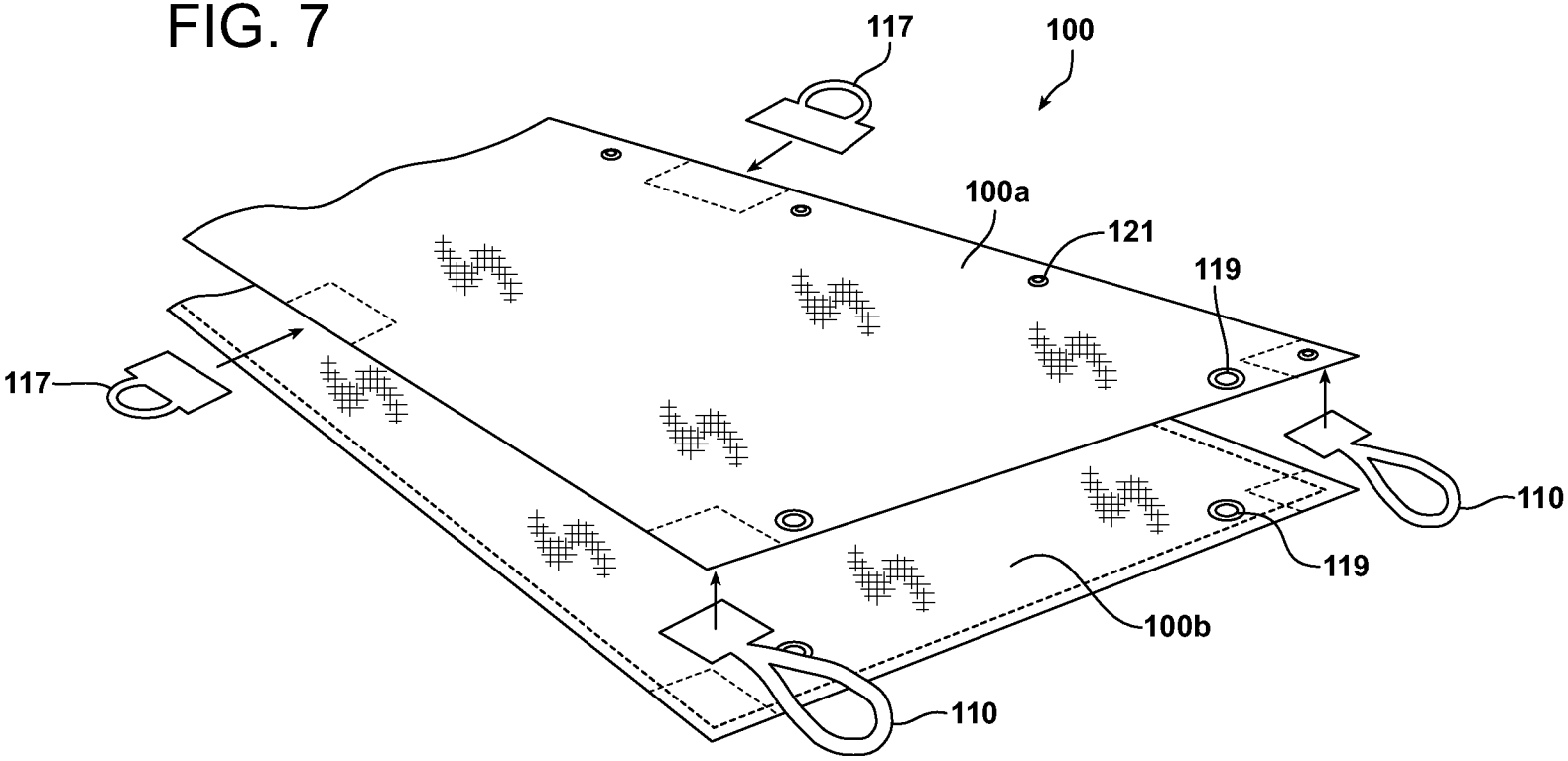
FIG. 7 is a partial, exploded view of the litter element showing the optional multi-layered construction of a litter panel, with the carry loops attached between the layers.
Figure 7A:
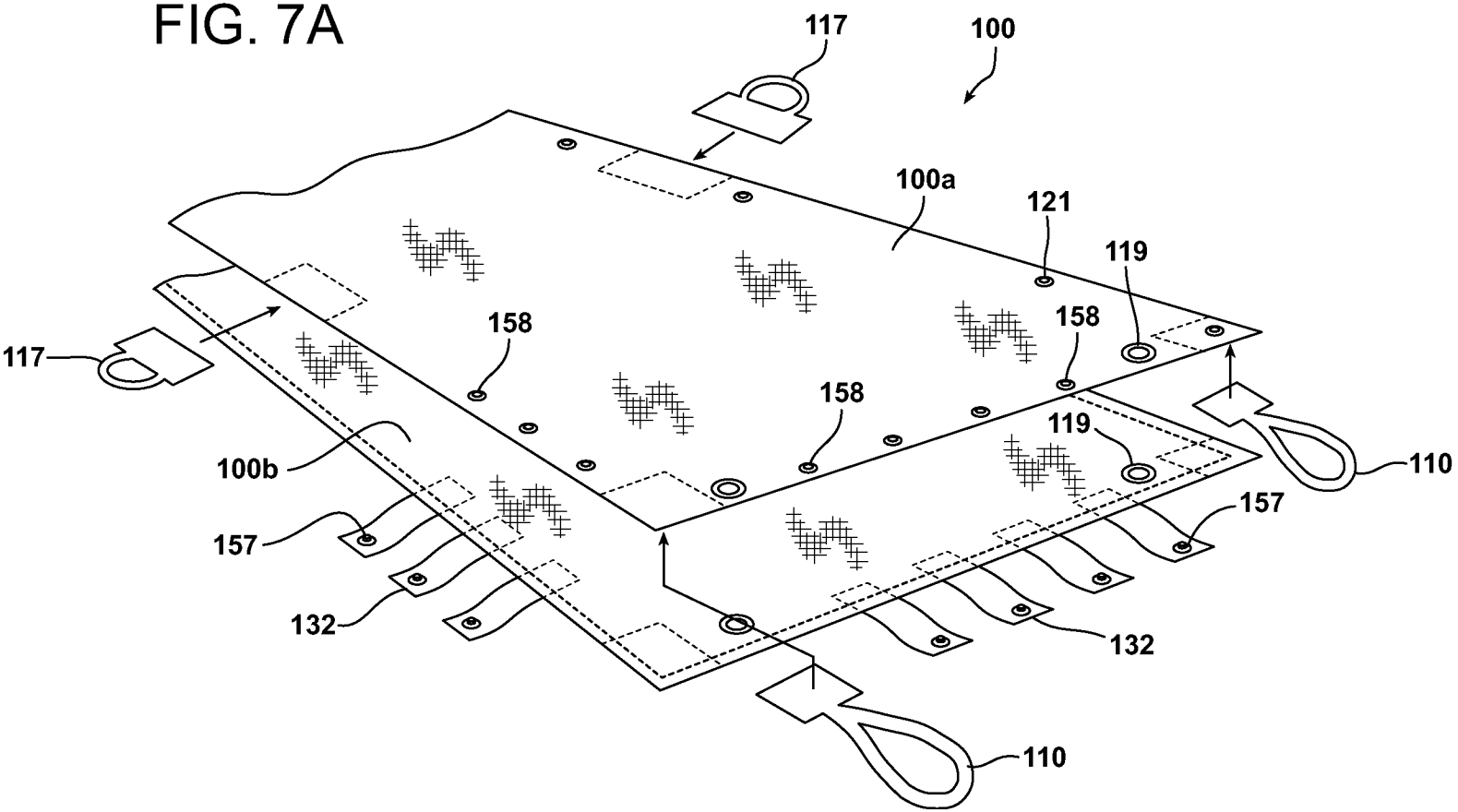
FIG. 7A is a partial, exploded view of the litter element showing the insertion of pole restraint straps and stabilizer bar restraint straps with pull dot snap fasteners affixed between the layers.
Figure 7B:
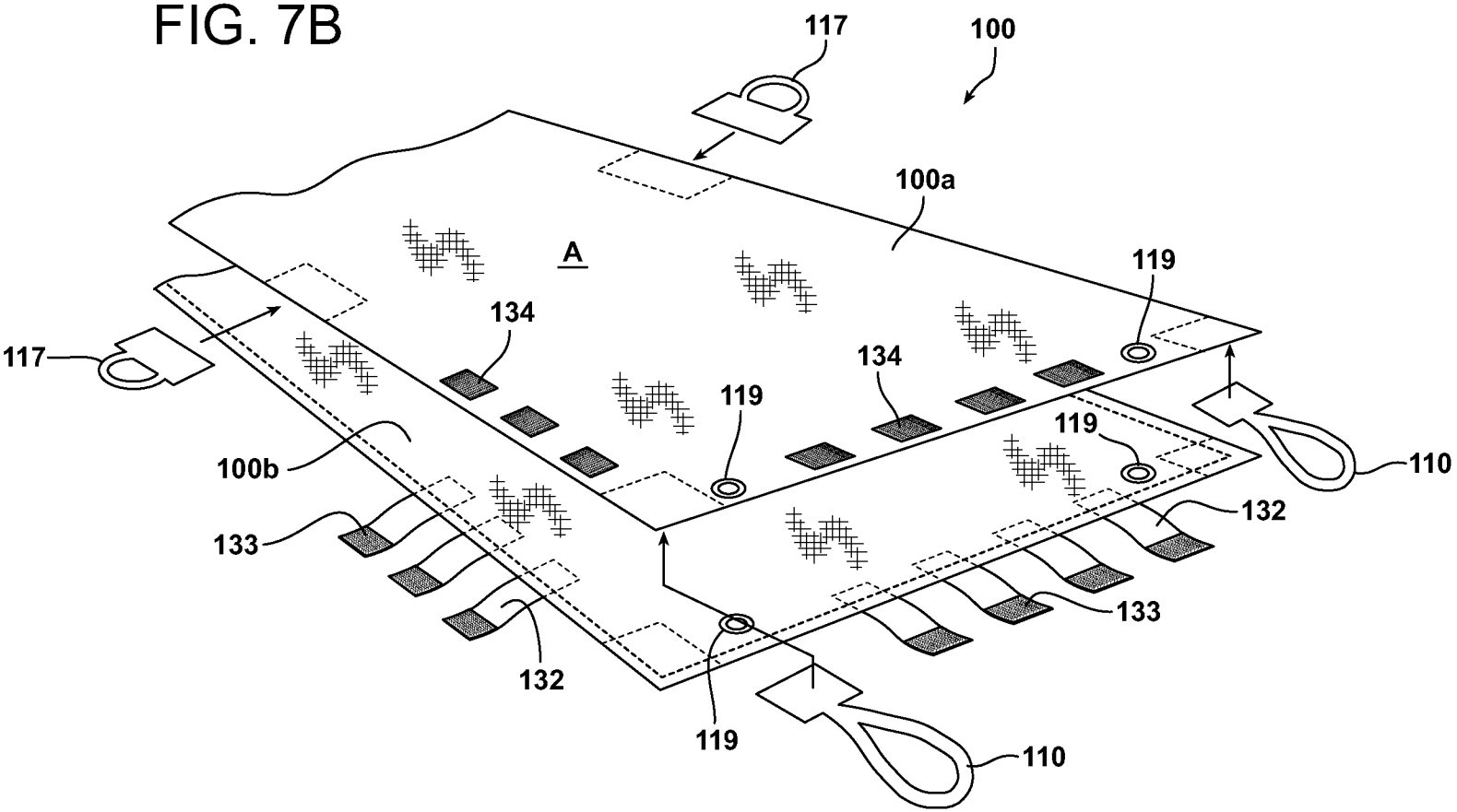
FIG. 7B is a partial, exploded view of the litter element showing pole restraint straps and stabilizer bar straps with VELCRO® hook and loop fastener tape closures affixed between the layers.

While several embodiments of the invention may incorporate a series of straps that form attachment means to hold the litter poles as described above, alternative configurations of the closure means for the straps to form loops are contemplated. In other embodiments, as exemplified by FIG. 7B, the straps may include a VELCRO® reclosable hook and loop fastener or other functionally adhesive type area that corresponds to a receiving area on the litter panel. As shown in FIG. 7, male or female VELCRO® reclosable hook and loop fastener portions 133 are affixed, by stitching, gluing or other means, to the ends of straps 132, 128. The corresponding male or female VELCRO® portion is sewn onto the upper layer of the panel (A) to correspond to the placement of the straps 128, 129, 132, 132a that are sewn in between the layers. Alternative fastener means shown are corresponding pull dot snap portions 157 and 121. In addition to snaps or VELCRO® , other closure means useful for securing load bearing configurations may be useful to form the loops at the sides or head or tail ends of the litter.

Figure 6C:
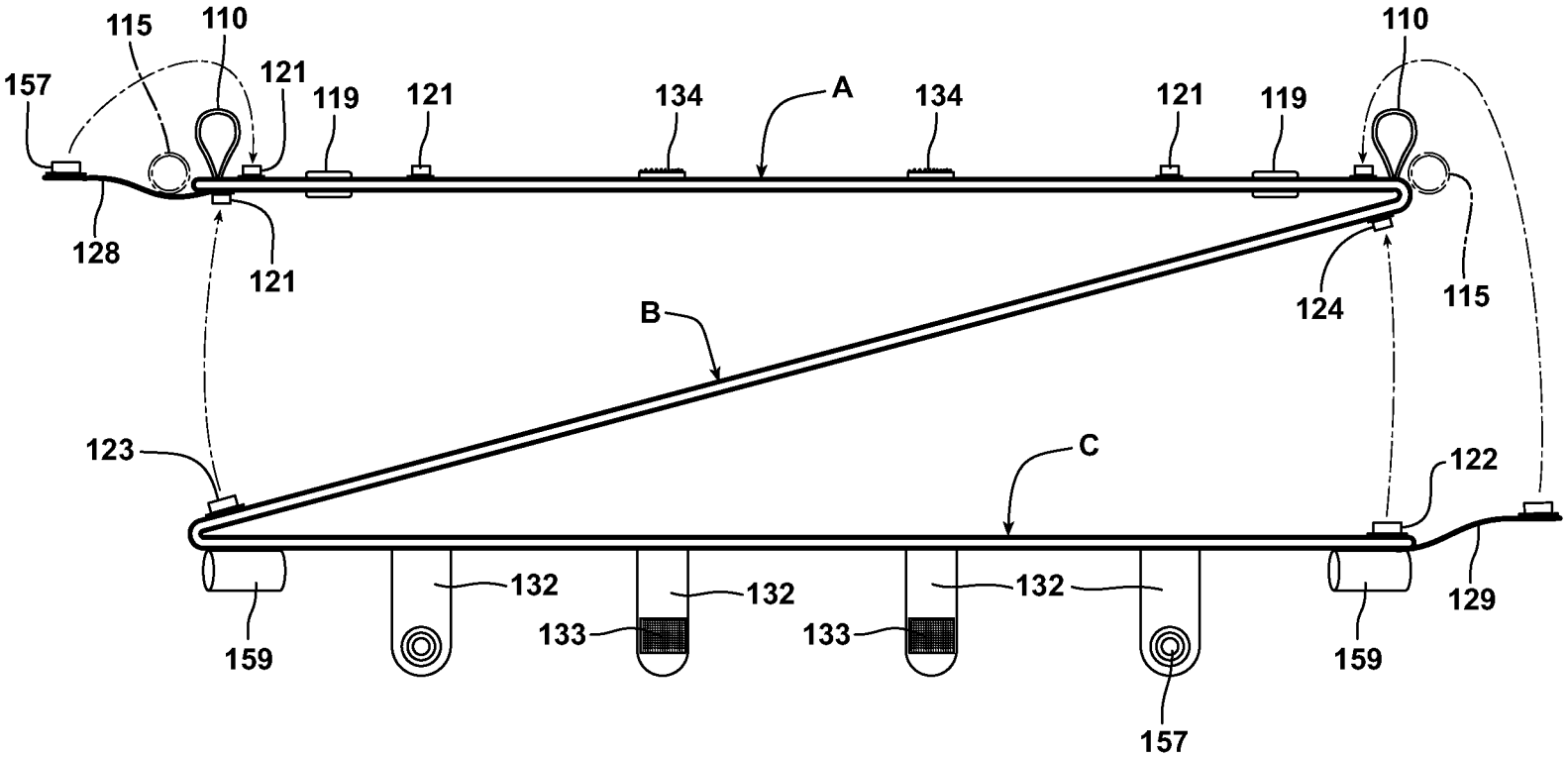
FIG. 6C is an end view of the head end of the litter element showing the folded litter panel and alternative fastener means for the stabilizer bar.
Figure 6D:
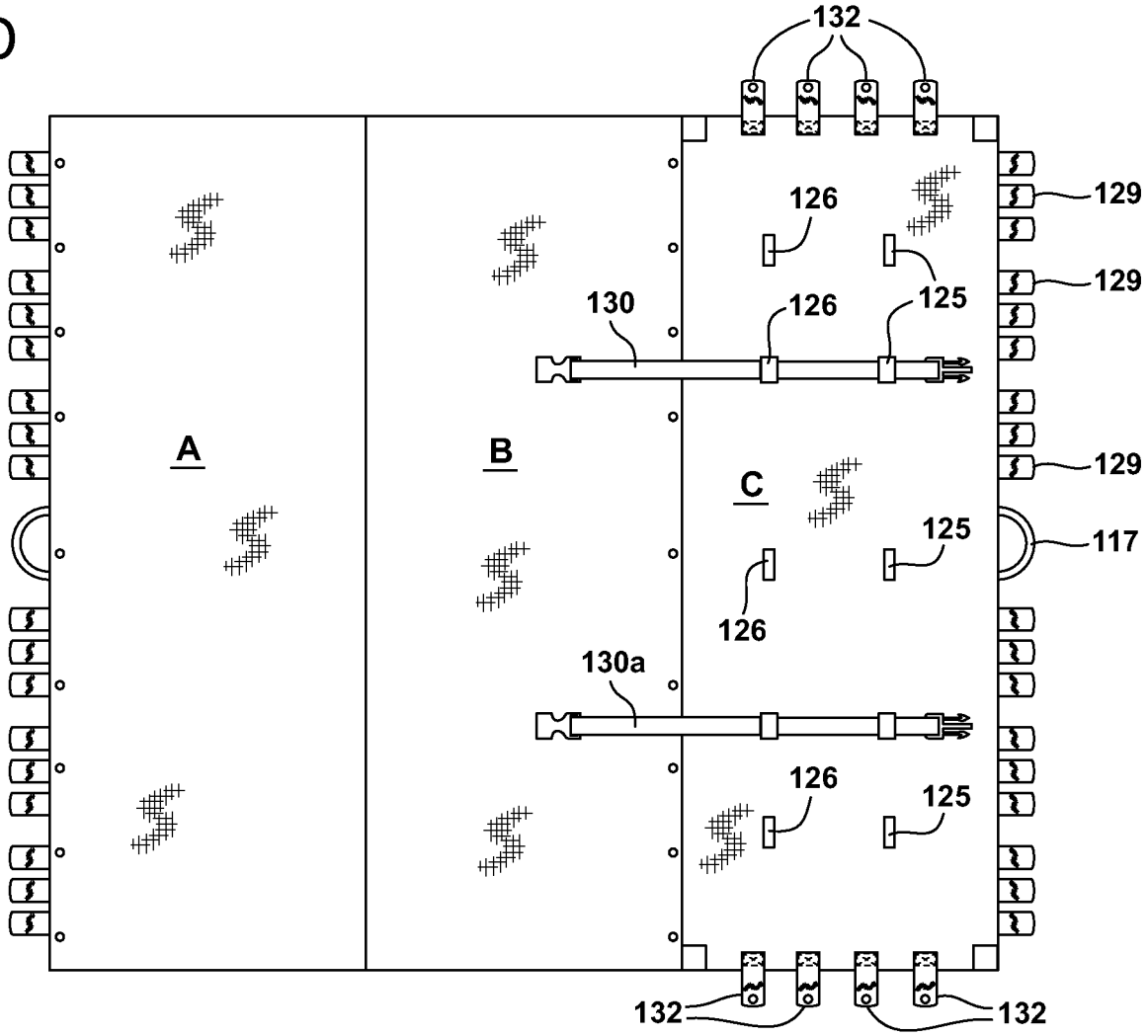
FIG. 6D is a planar view of the unfolded litter panel according to the invention comprising pole straps and stabilizer bar straps.

The straps used to form the loops for the litter poles or the stabilizing casualty restraint bars may be attached to the litter having a combination of closure mean, for example some with pull dot snaps and others with VELCRO® hook and loop fastener tape closure means, without limitation, as shown in FIG. 6C. FIG. 6C is a representation of an end view of the litter element showing the accordion fold of layers A, B and C and the relative placement of heavy duty carry loops 110 in relation to pole sleeves 115, stabilizer bar restraint straps 132 with VELCRO® hook and loop fastener tape fastener means 133, stabilizer bar restraint sleeves 159, pole straps 128, 129 and VELCRO® hook and loop fastener tape attachments 134 for attaching the stabilizer bar restraint straps 133. The layout of the head and tail end are similar in design and construction. FIG. 6D is a planar view of a litter element according to the invention which shows the underside of the litter element 100 and the placement of the casualty restraint straps 130 and loops 125, 126.

Figure 18A:
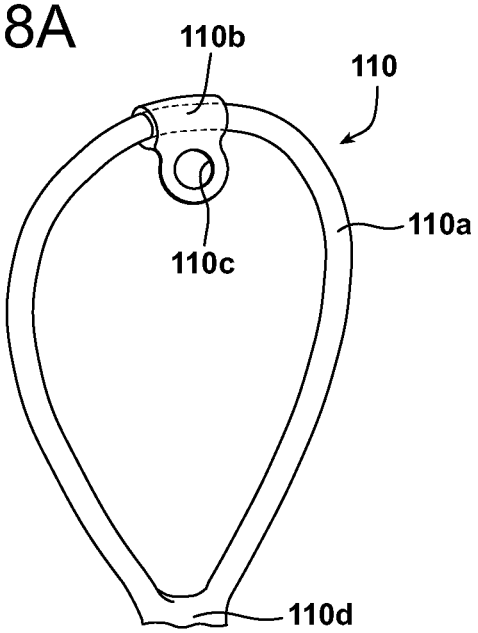
FIG. 18A is a planar view of the carry loop of the litter element.
Figure 18B:
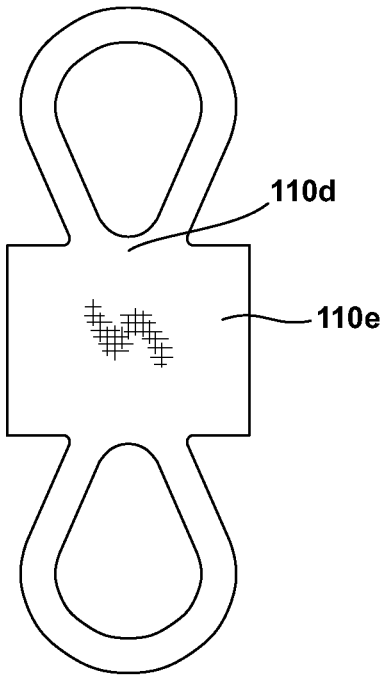
FIG. 18B is a planar view of the template of the carry loop.

FIG. 7 is an exploded view of the layers of the litter panel (two layers) showing the position of heavy duty carry loops 110 and 117. An exemplary construction of the carry loops is shown in FIG. 18A. The loops 110 are formed from a heavy duty material, e.g. nylon, and may be formed in rounded, tubular fashion to reduce the likelihood of friction when in use. As shown in FIG. 18A, an eyelet 110*c* is included in the loop design to help arrest movement of the snap hooks or carabiners that may be attached to the loop. The eyelets are flat and rigid so as not to interfere with the carry loops when they are being carried by hand. This design ensures that the litter remains in a stable, lateral position when being hoisted into the air by a rope or helicopter cable or rescue winch. As shown in FIG. 18B, the base 110*d* of the loop portion 110*a* is affixed to or contiguous with, i.e., cut from one sheet, with a tab portion 110*e*, which is flat for insertion between the layers of the litter panel 100*a* and 100*b* as shown in FIG. 7. The same schema and construction may be employed for loops 111 and 117.

Figure 7C:
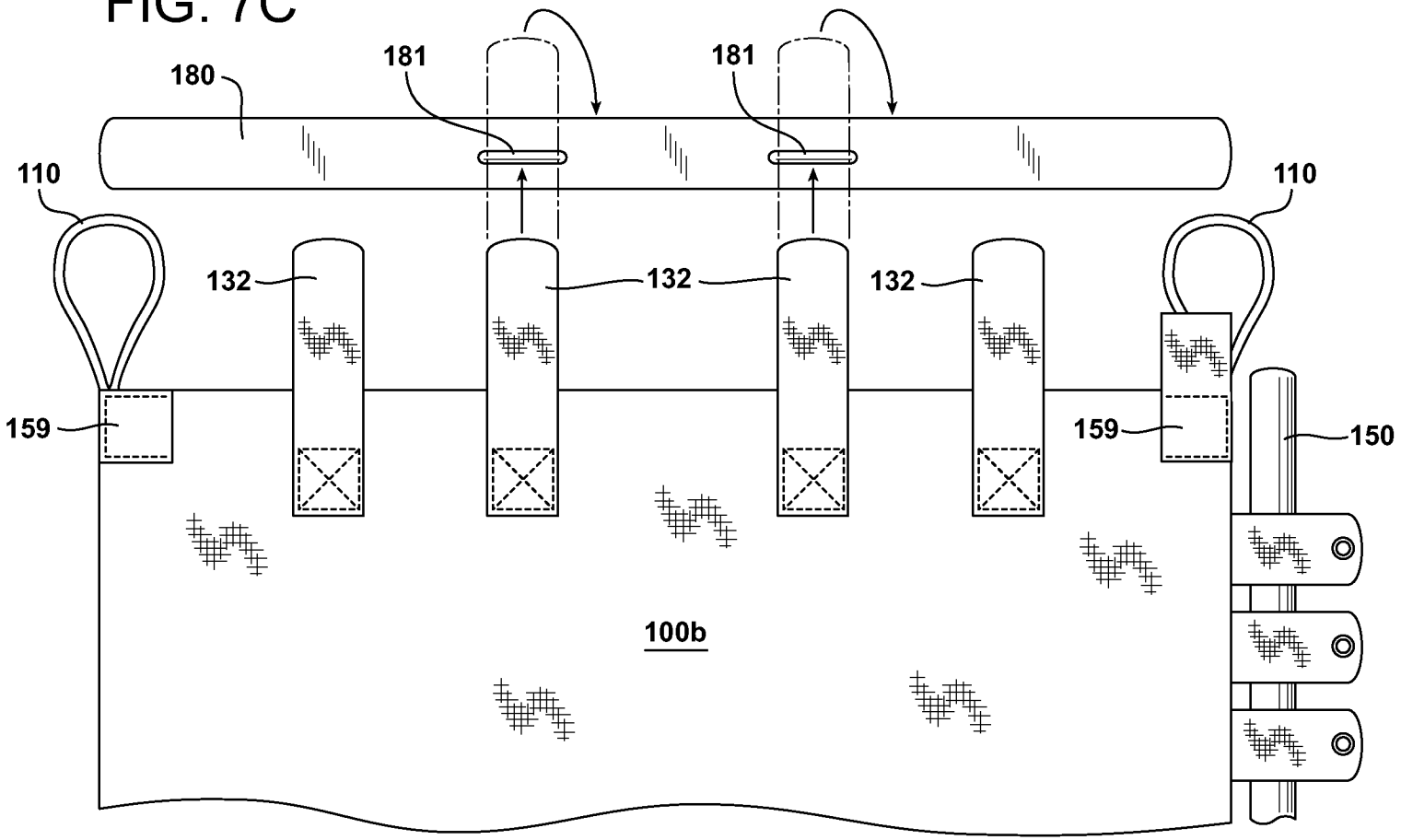
FIG. 7C shows the corresponding location and operation of the stabilizer bar and telescoping pole in relation to the stabilizer bar restraint straps and pole restraint straps.

When it is used as a litter or transporting a casualty, the litter element of the portable transport system is stabilized by the inserted poles attached to the length of both sides of the litter. Additional stabilization is desirably obtained by employing stabilizer bars at the head and tail end of the litter. According to FIG. 7*c* stabilizer bar 180 is equipped with slots 181 that are sized to hold the width of stabilizer bar restraint straps 132, which are passed through the slots 181 and looped over the bar 180 before being fastened to the corresponding snaps or VELCRO® reclosable hook and loop fastener attachments to form secure loops that hold the bar in place. FIG. 7C also shows the stitching of the straps 132 which is visible from the underside of the panel at layer 100*b*. A similar folding mechanism of pole restraint straps 129 over pole 150 to attach it to the litter is also shown. Pockets 159 are disposed at each corner to receive the ends of the stabilizer bar 180 to keep it from slipping out of the loops.

The frame of the portable transport system comprises at least two telescoping poles positioned parallel to each other to accommodate each side edge of the litter element, wherein each of the at least two poles is comprised of segments in series. The poles are preferably composed of a lightweight metal or rigid material such as extruded aluminum. TEFLON® nonstick polytetrafluoroethylene-coated fabric, KEVLAR® high-strength, wholly aromatic polyamide fabric, PVC, or similar materials or combinations thereof. Each fully extended telescoping pole is inserted into the pole sleeve or the loops formed by the pole restraint straps along the length of one side edge of the litter element to provide a rigid support means for load bearing and transport as drag poles. It should be understood that alternative locking means may be used to hold the segments of the pole in fully extended position in relation to each other and to provide for their telescoping and storage when not in use. When fully extended to their maximum length and locked in place, the poles support the full length of the side edges of the litter. To fold the transport system, the telescoped poles may be removed from the edges of the litter. Each segment of the pole may then be unlocked from and inserted into the next adjacent segment in the series to collapse and reduce the overall length of the pole. The collapsed pole may then be withdrawn and stored.

Figure 13:
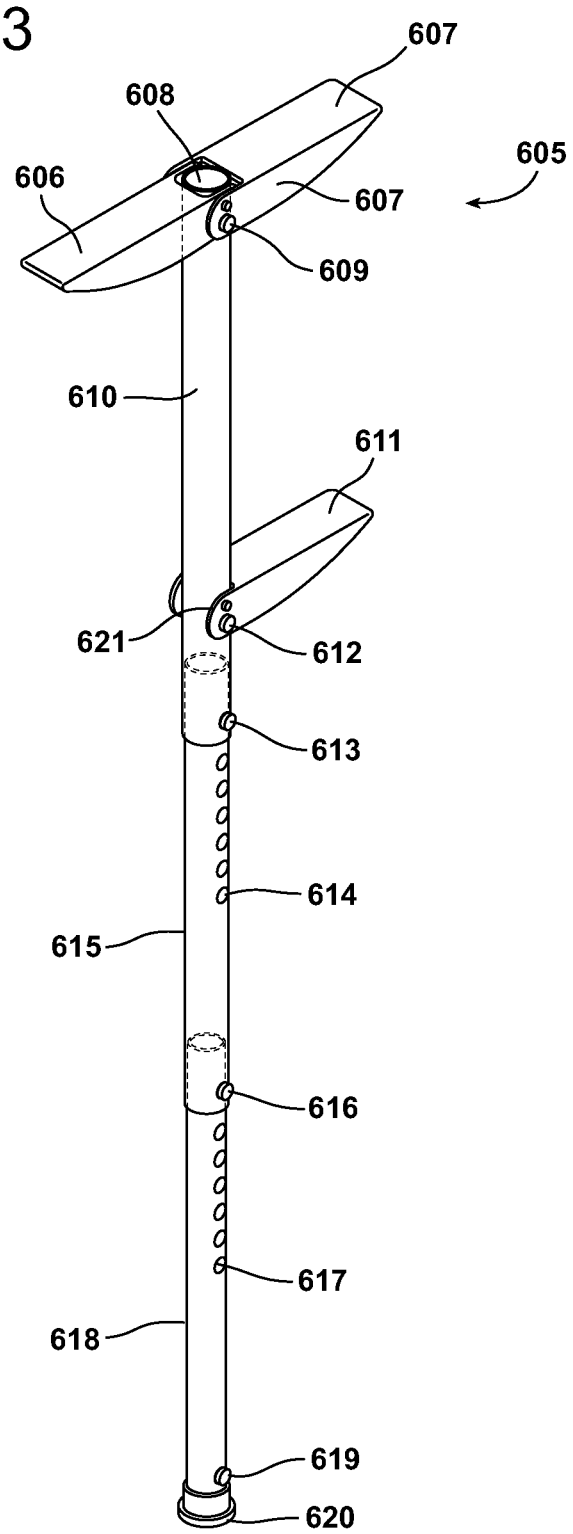
FIG. 13 is a three dimensional view of the telescoping pole configured as a crutch.

An exemplary telescoping pole according to the invention is represented at FIG. 13. Each segment 610, 615, 618 of the drag pole 605 is insertably related to the adjoining segment such that all or a portion of a segment may be inserted into or withdrawn from the adjoining segment in the series to form a telescopically extended pole, the communicating segments of which may be locked in place to create a pre-determined length. For example, segment 618 has an open end into which may be inserted a corresponding end of segment 615, which can then be locked in place by means of a cotter pin 616 (or alternatively other means such as a screw or nut and bolt). According to the example, cotter pin 616 is inserted into one of holes 617 to provide the desired elongation of the combined segments. Similarly, segment 610 may be inserted into the unengaged open end of segment 615 and locked in place with cotter pin 613 inserted through holes 614.

Figure 14:
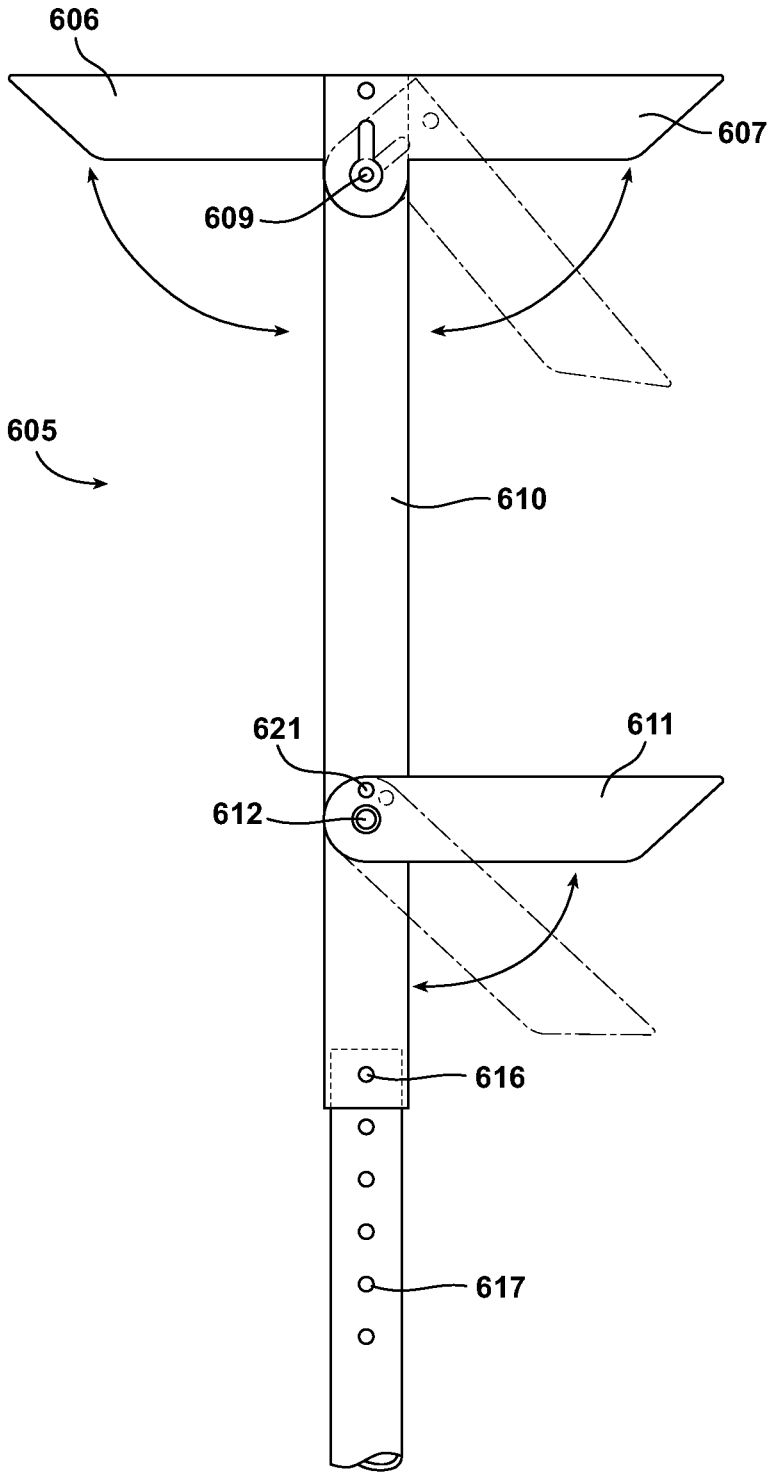
FIG. 14 shows a planar view demonstrating the operation of the crutch components.

The fully extended poles may, in an alternative embodiment of the invention, be configured with a handle element at one end. In this regard, the handle allows the pole to be convertibly used as a crutch or walking stick by a person in need of support for walking. The handle element, in full extension for use, is perpendicularly positioned in relation to the axis of the pole, however it may be formed of foldable portions which may be folded at 90° angles to align parallel with the axis of the pole element when the handle is not required to be in use. According to FIG. 13, the pole has handles 606 at the top end of the pole 608 that can be extended horizontally (perpendicular to the assembled pole segments). When extended horizontally, as in FIG. 14, the top handles 606, 607 form the underarm support for using the pole assembly as a crutch. The top handles are made of flat, molded aluminum or similar material. An additional lower handle or hand grip 611 may also be attached distally from the top of the pole at a height conducive to the crutch pole being used as a hand grip. As seen in FIG. 14, the portions of the handle element are centrally connected to the top or proximal end of the pole by insertion of a cotter pin or rivet located at the point of connection. The pin is inserted into an elongated slot of varying size at each end thereof, wherein one end has an opening wider than the diameter of the pin to allow for insertion and movement along the vertical axis of the slot, and a hole disposed to approximately accommodate the diameter of the pin without lateral movement, thereby locking it into place. The handle portions are locked in place by extending each portion perpendicular to the top of the pole and sliding the pin upward in the elongated slot to lock it in place and thus tightly secure the handle portions in the perpendicular extended position. The handles 606, 611 have an angular range of motion of approximately 90 degrees, allowing them to be extended horizontally when the pole is used as a crutch, or to be moved into a parallel, vertical position when the pole is being used for other purposes, for example as a litter support. The operation of the hand grip 611 replicates the range of movement of the top handle 606 above it. The handles may be detachable to allow even greater flexibility in the use of the poles.

Figure 11:
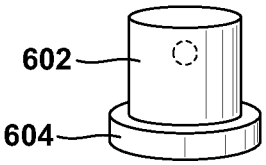
FIG. 11 is a representation of a base cap which may be attached to one end of the telescoping pole according to an embodiment of the invention.

At the distal end of each pole and opposite the handle end there is optionally disposed a base cap that may be formed of a coated metal or plastic or entirely of a skid-resistant material, and further which, when disposed over the tip of the distal end segment, provides a cover and stabilizing means for grasping or leaning on the end of the pole when it is used as a crutch or walking stick. When the pole is used as a support element for the litter to allow dragging or carrying of a patient, or as a walking stick or crutch, a base cap with a smooth tip, preferably also made of a non-skid material, may be affixed to the end of the pole that is distal to the handle. As shown in FIG. 13, base cap 620 is inserted into a hole at the lower end of the lowermost segment 618 and locked in place with a cotter pin to provide a slip resistant surface for contact with the ground or floor surfaces. The base cap is a round, hollow piece of aluminum of sufficient size to slide over the end of the tube segment. As shown in more detail in FIG. 11, the hollow cap has a slightly larger flat plate incorporated into its construction which may be textured or rubber coated to give support and surface grip to the crutches when they are in use.

Figure 12A:
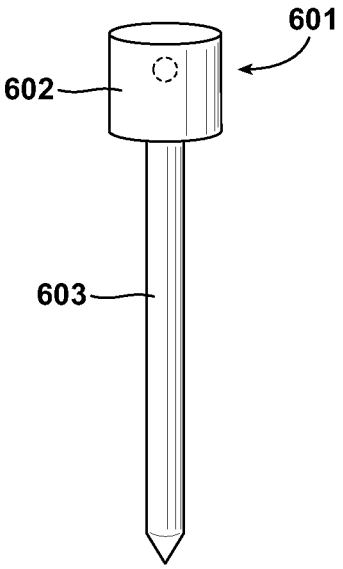
FIGS. 12A, B and C show alternative embodiments of the spiked base cap elements which may be attached to the end of the telescoped pole.
Figure 12B:
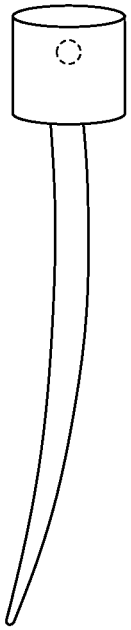
Figure 12C:
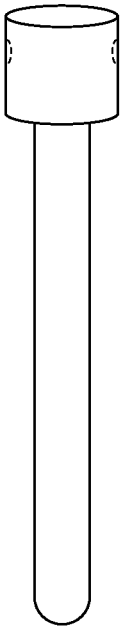

Alternate configurations of the base cap may be fitted to the end of the poles depending on the intended use, for example in FIGS. 12A-C, which show various spiked attachments. When the pole is intended to be used as a support post for a tent or other shelter configurations of the transport system, an alternate base cap which may include a spike element may be substituted at the end of the pole. The spiked base cap may take the form of a pointed spike (FIG. 12A), a curved spike (FIG. 12B) or a cylindrical spike (FIG. 12C). The exact shape is selected depending on the ease of penetration of the substrate, propensity for bearing weight, etc. The spike may be an elongated vertical shape that may be straight or curved into an arc, and as in FIG. 12A, may have a pointed end 603 for penetration of a substrate to a depth that would provide adequate support to the erect pole for load bearing.

Figure 15:
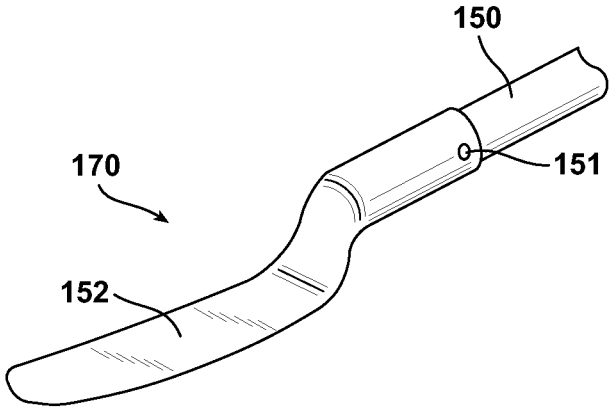
FIG. 15 is a perspective view of a sled drag travois attachment.
Figure 16:
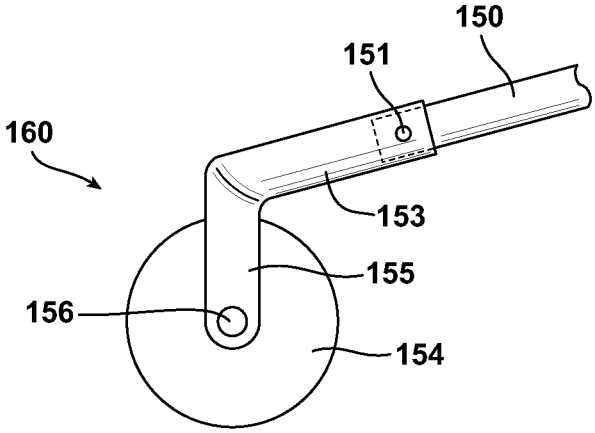
FIG. 16 is a perspective view of a wheel travois attachment.
Figure 17A:
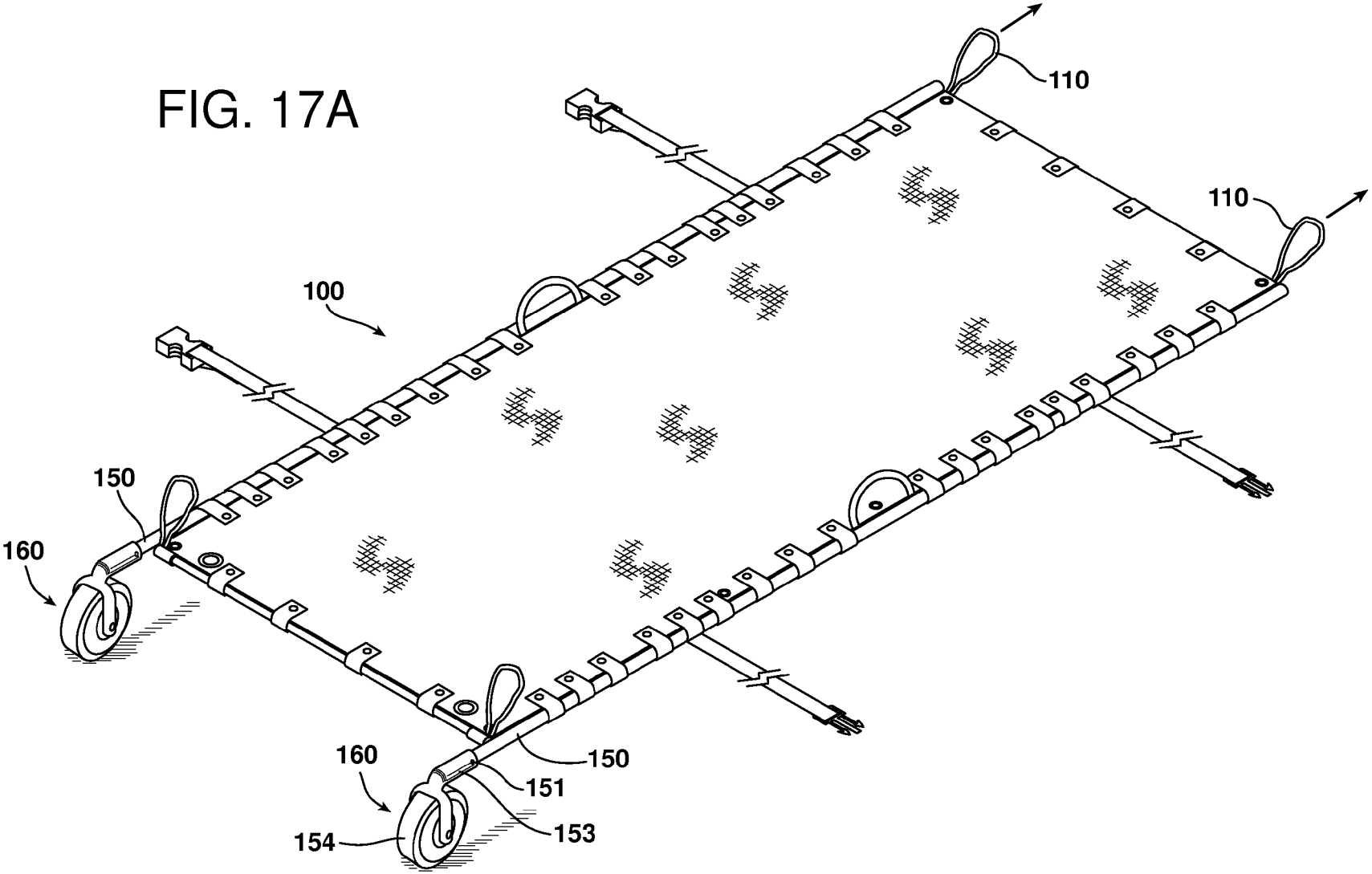
FIG. 17A is a perspective view of a travois according to the invention fitted with wheel attachments.
Figure 17B:
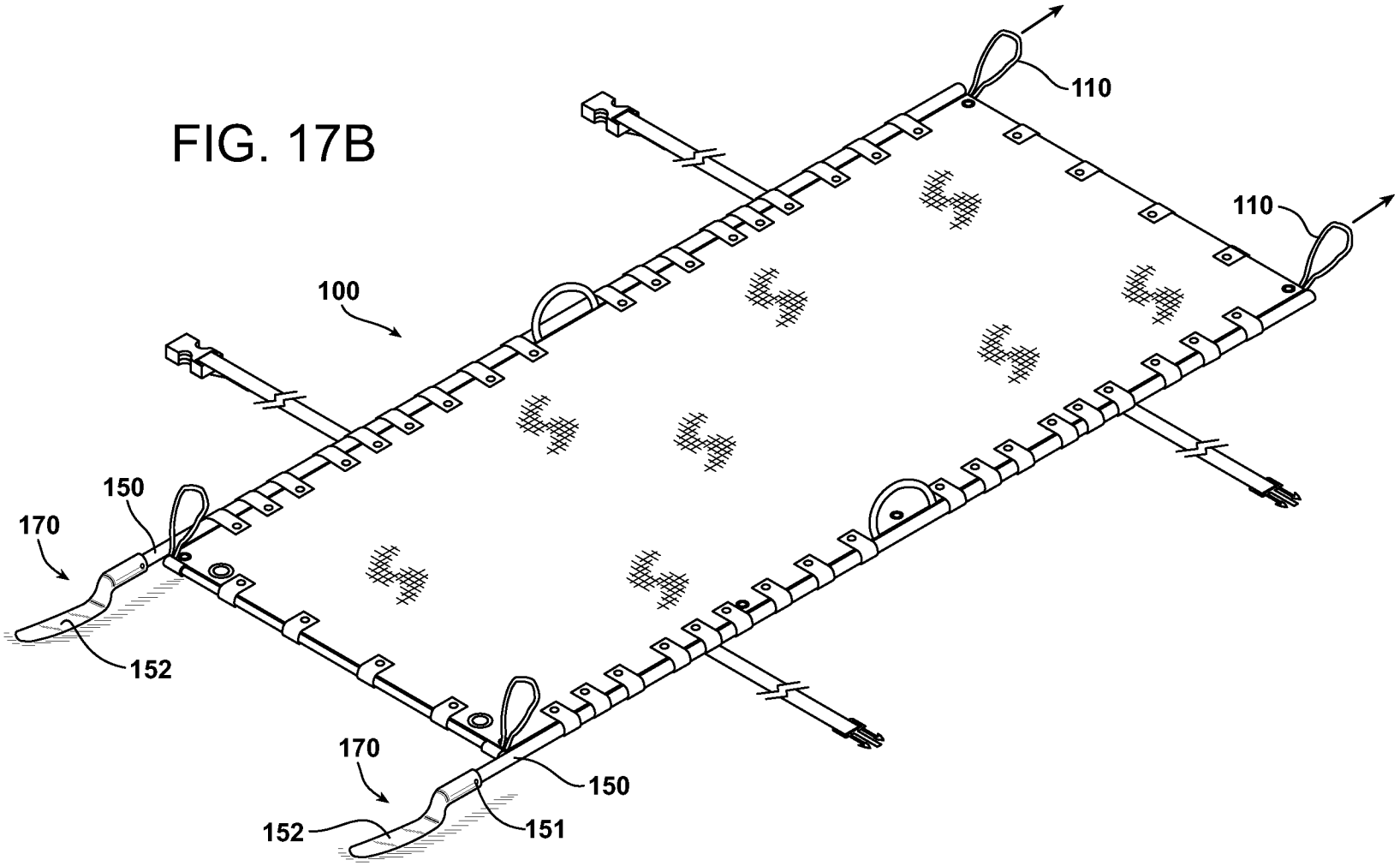
FIG. 17B is a perspective view of a travois according to the invention fitted with sled drag attachments.

The invention may be used in a travois configuration so that it can be pulled or dragged across various types of terrain. While the poles may have base caps configured as a simple end closure or as spikes for insertion into the ground, other functional apparatus may replace the base caps for this purpose. FIG. 15 shows a sled drag attachment 170, which has an opening on one end to receive the end of telescoping pole 150. The pole is locked in place via cotter pin 151. The distal end of the drag attachment is a flat, planar end 152 which is designed to skim the ground surface as the litter is being pulled, for example over snow, sand, dirt, mud or other surfaces. The curved shape helps the travois to move over obstacles such as rock, small logs, etc., without becoming snagged. Alternatively, as in FIG. 16, a wheel attachment 160 may be connected to the end of the telescoping pole 150. At the upper end a tubular shaft, for example of aluminum 153, is curved to form an axle 155. The lower end of axle 155 is forked to fit over a wheel 154. Axle 155 terminates in attachment means 156, such as a bolt, which secures the wheel. The forked extension 155 is positioned at an angle, from about 80 to 90 in relation to the telescoping pole when the portable human transport system is used as a travois. The wheel attachment can be manipulated to move the litter over solid terrain or other hard-packed or paved surfaces. FIG. 17A shows the litter element fitted with wheel attachments. FIG. 17B shows the litter element fitted with sled drag attachments. In either of these embodiments, the stabilizer bars and poles are attached to the folded litter element and heavy duty carry loops are attached to the rescue harness (see FIG. 1). The sled drag or wheel attachments are affixed at the end of the litter opposite the harness, at the smallest diameter of the elongated poles. The casualty restraint straps are pulled and fastened over the injured person, optionally with a support seat also fitted, and optionally with a head restraint. The seat support and head restraint are further discussed herein.

Figure 8:
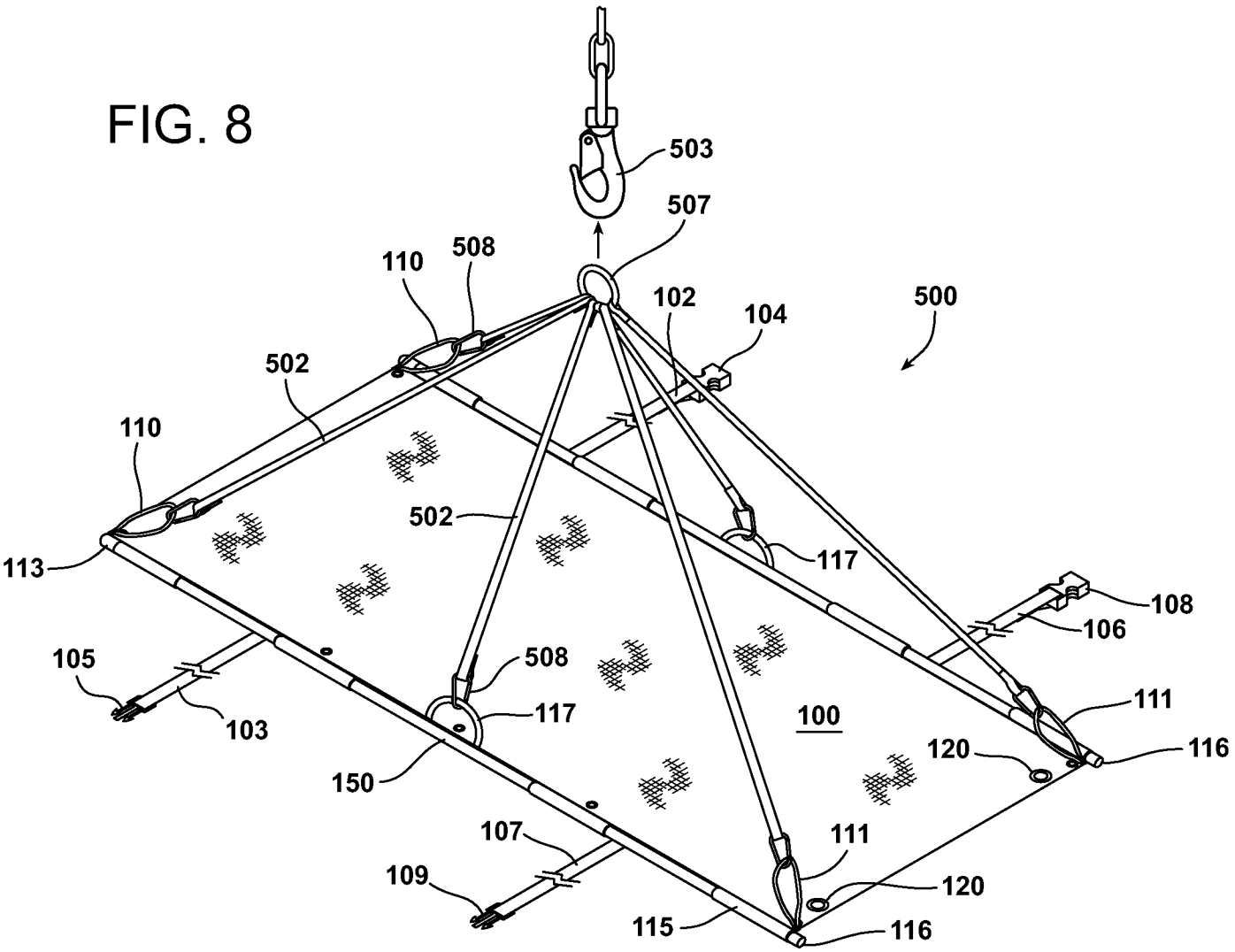
FIG. 8 is a three-dimensional view of the litter panel showing a lift assembly for aerial transport.
Figure 8A:
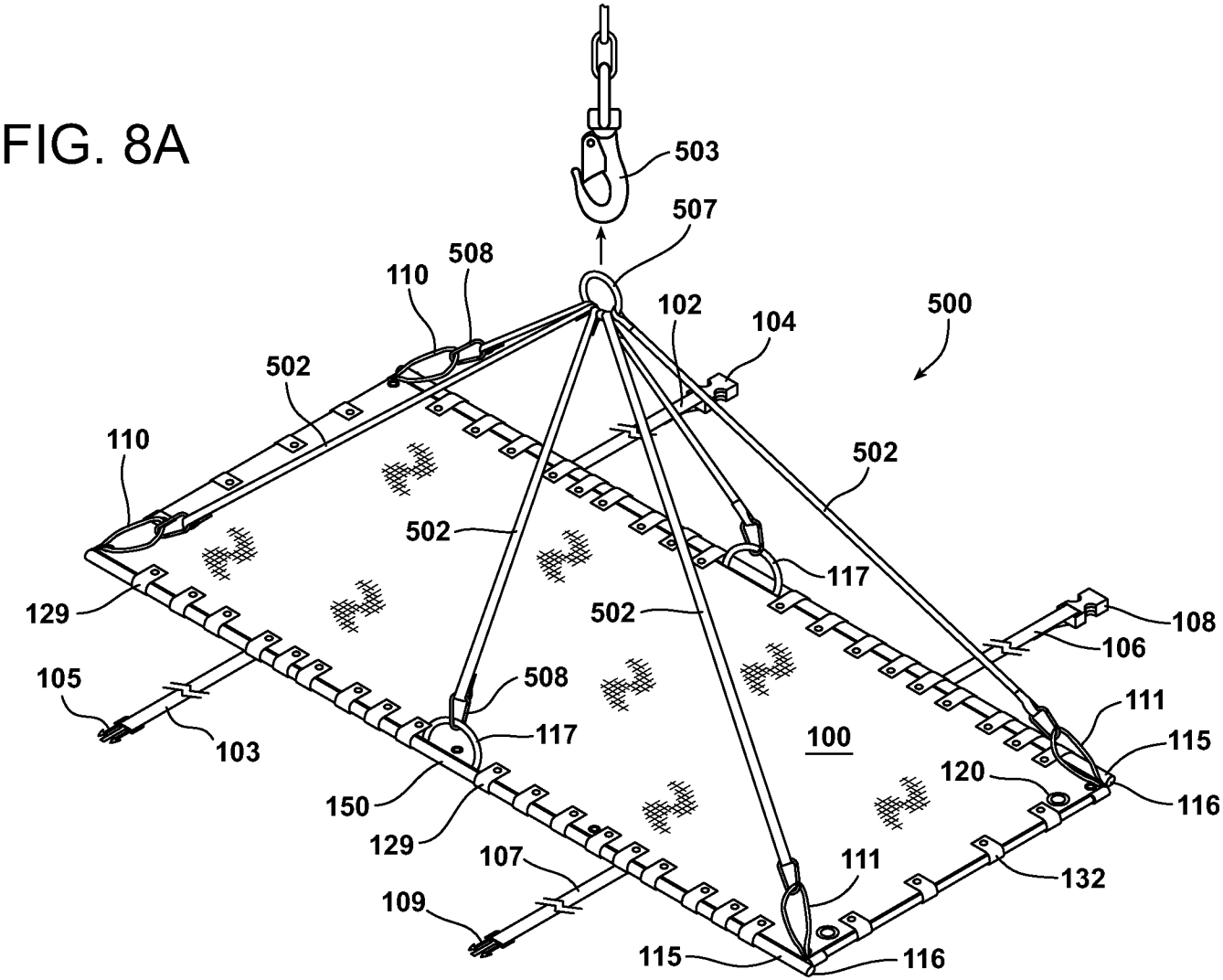
FIG. 8A is a representation of an alternate embodiment of the lift assembly.

The portable human transport system of the invention may be used in aerial rescue efforts. In one embodiment, the invention comprises a lift assembly for airlifting the system that is facilitated by a harnessing lift assembly and process. The lift assembly comprises a heavy duty metal ring to which is sewn a series of heavy duty, resilient lift straps made, for example of tubular nylon. The straps are of fixed length and are terminated at the ends opposed to the ring by locking carabiners which are permanently sewn in place. Some of the straps, preferably about four, are of a fixed length to reach the carry loops at the corner of the folded litter element, while the remaining straps (two or more) are of fixed length corresponding to the distance from the metal ring to the centrally positioned carry loops. To attach the lift assembly, the locking carabiners at the free ends of the straps are attached to the carry loops on the corners and sides of the litter element, and the ring is then hoisted by an aircraft such as a helicopter. The metal ring may be attached to the helicopter via a twist clevis or other form of secure attachment means In the particular embodiments of FIGS. 8 and 8A, the lift assembly 500 includes lift straps 502 connected, for example by carabiners 508, to the carry loops 110, 111, 117 of the litter element. The other end of the lift straps are attached to a center bezel ring 507, which can be connected to a twist clevis 503 which is suspended from a helicopter winch cable for aerial lift. The lift straps are preferably permanently attached to a center bezel ring 507 so that the lift assembly can be maintained in a condition for ready and easy attachment to the loops of the litter element. Alternatively, the lift straps may be attached to another form of aerial lift means other than a twist clevis. With respect to the operation of the lift assembly, the opposing end of each lift strap is attached to an edge loop of the litter element. The gathered straps 502 form a stable lift assembly, and also create a safety in conjunction with the frame element of the litter basket effect that helps to secure the casualty. The frame element of the litter in this respect is defined by the edge loops that are connected to the lift straps and the telescoping poles. The casualty restraint straps are fastened over the casualty's body to secure it for aerial transport.

Figure 19:
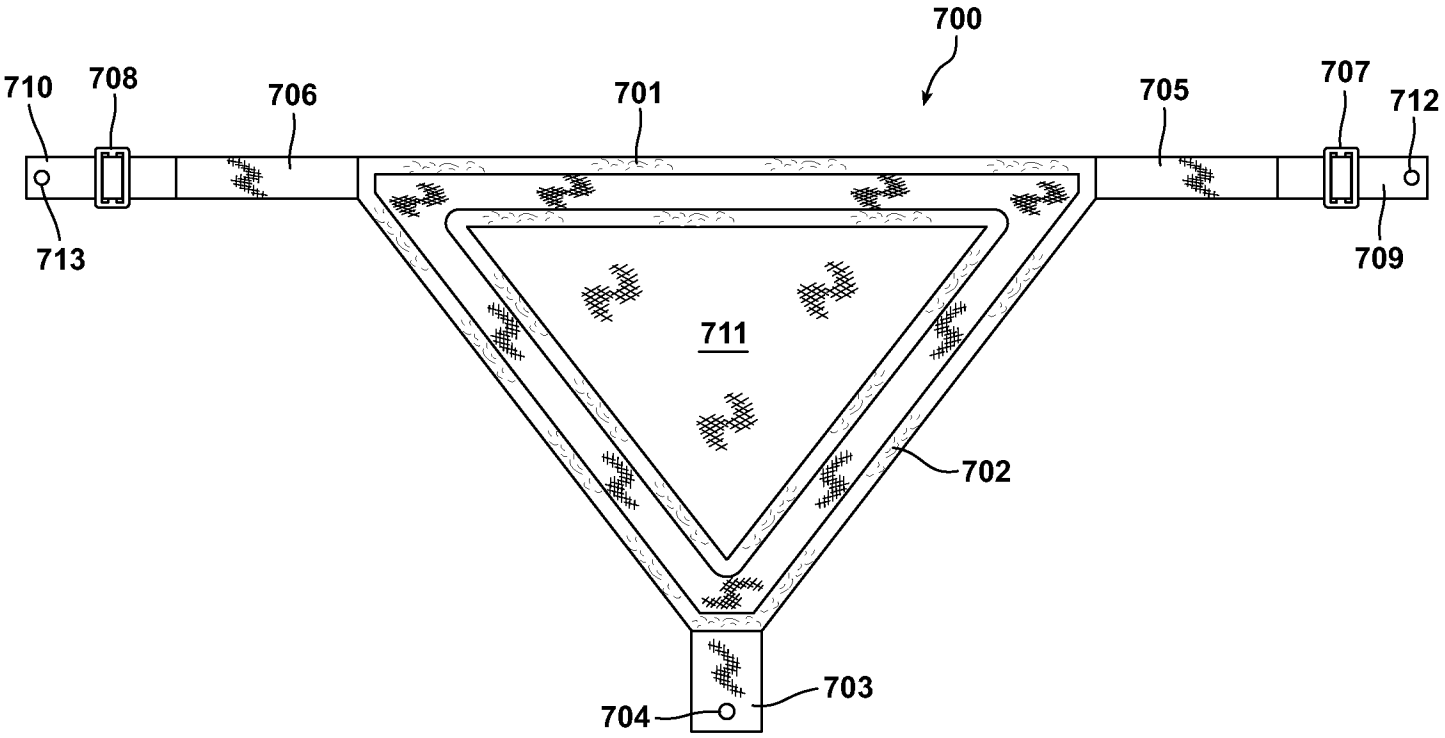
FIG. 19 is a planar view of a seat support system component of the invention.

A seat support may be attached to the litter panel to stabilize the casualty's body from slipping while the litter is being transported in travois configuration, and to also secure and protect the casualty's pelvic area. In the embodiment of FIG. 19, seat support 700 has a triangular section 702 with a padded groin cradle 711. The seat support and the exterior of the groin cradle may be formed of CORDURA® durable, high-tenacity fiber fabric or other fabric useful for the litter, and the padding may be selected from any lightweight material with loft, batting or which provides a cushioning effect against physical impact. The edges of the seat support 700 are also lined with the padding material to aid the comfort of the patient while in travois travel mode. Belt 701, which is attached to one edge of the triangular section 702, includes strap portions 705, 706 to provide a means of securing the support around the waist. Buckles 707, 708 provide adjustment means to accommodate the girth, and then ends709, 710 can be fastened by fastener means such as pull dot snaps 712, 713 to corresponding fastener means on the flat panel of the litter element 100. In use, the seat support is placed over the waist area of the casualty and strap 703 is passed between the patient's legs at the inseam. The strap 703 is fastened for example by pull dot snap 704 to a corresponding snap on the flat panel of the litter element (see FIG. 20).

Figure 20:
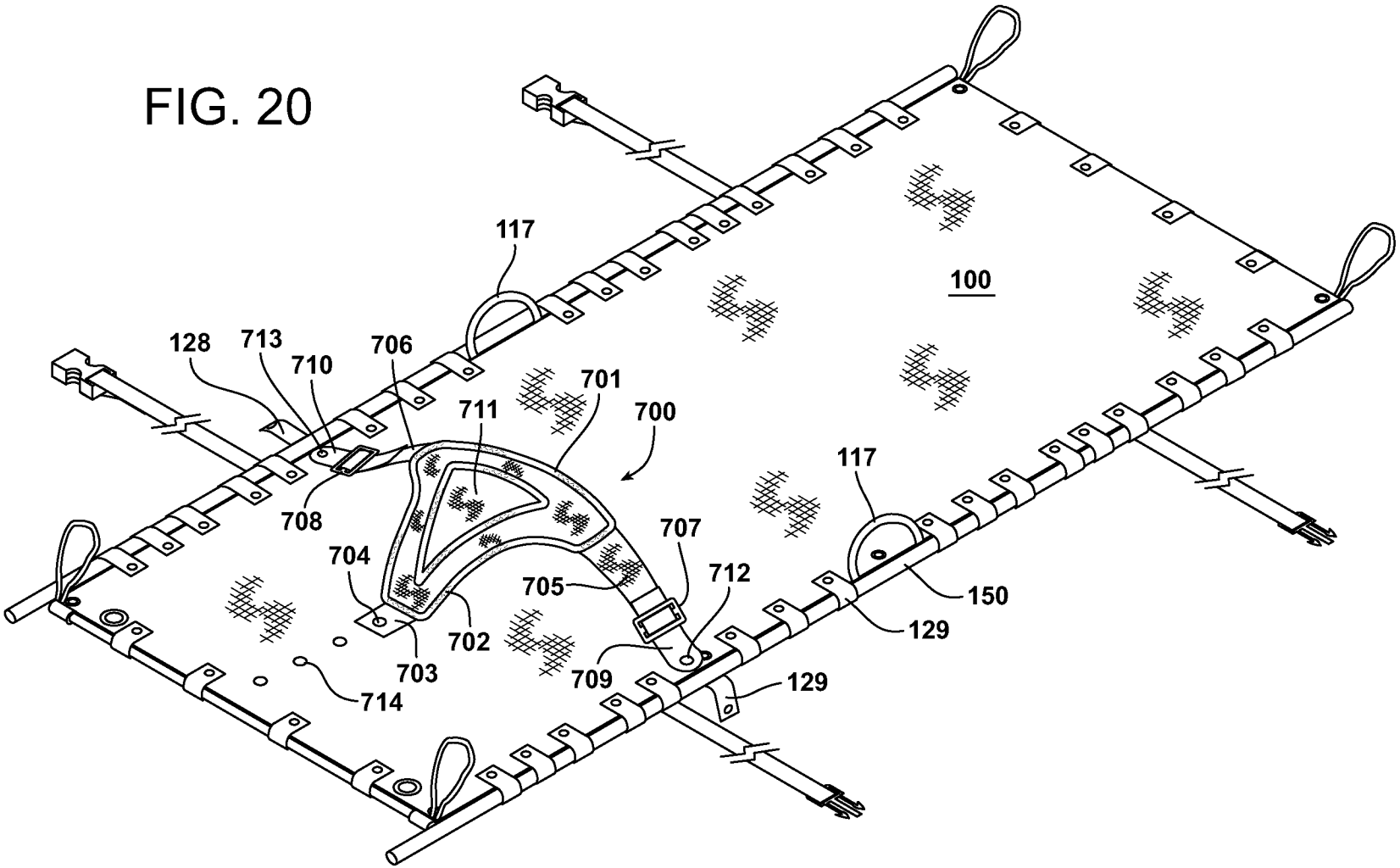
FIG. 20 is a view of the litter element with the seat support attached.
Figure 21:
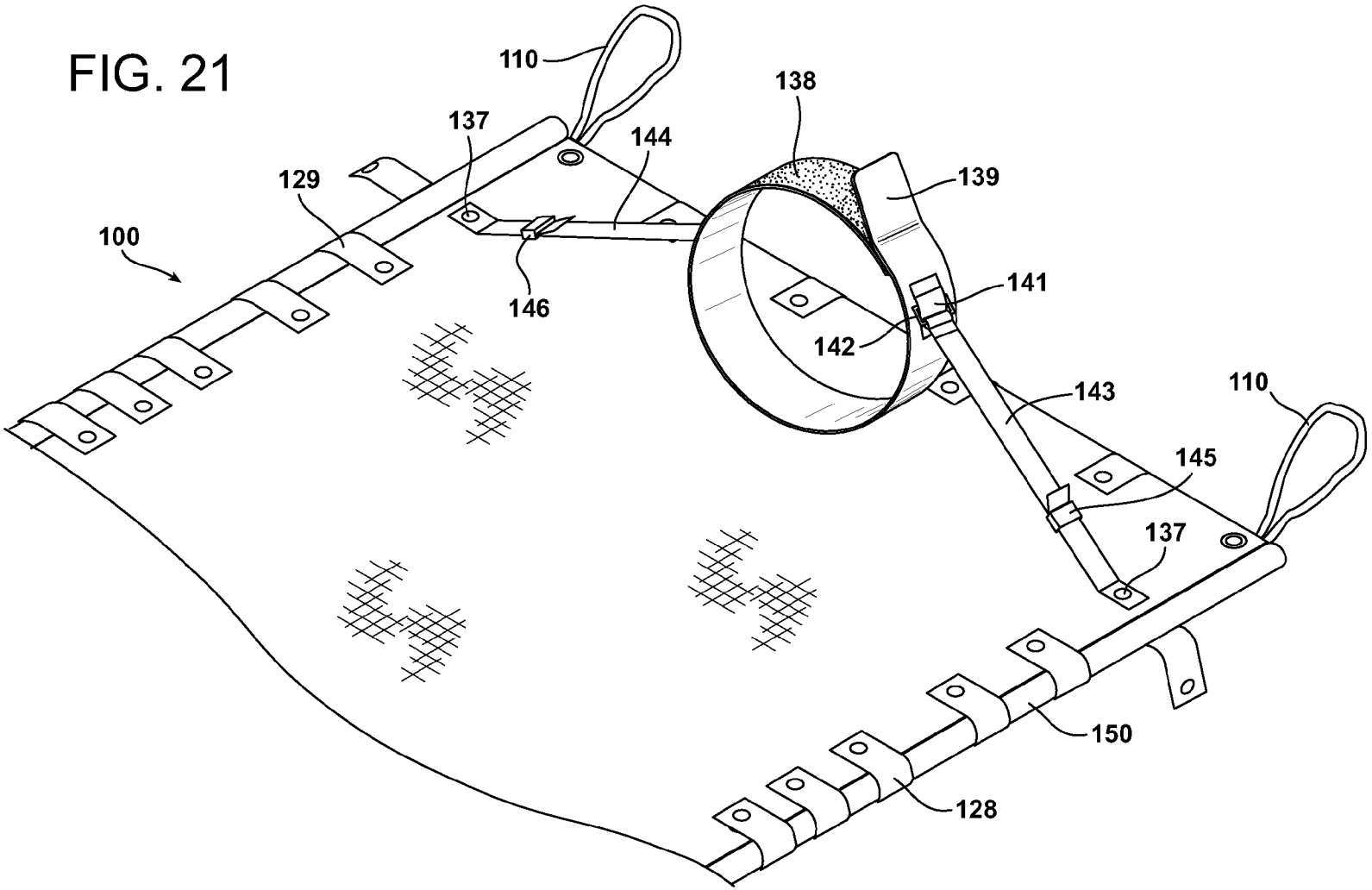
FIG. 21 is a view of a head restraint system attached to the litter element.

FIG. 20 shows the litter element of the system fitted with the seat support system attached to the litter panel 100. The pull dot snaps 712, 713 may be female ended snaps of the same type and size as the snaps used to fasten the pole restraint straps 128, 129. The pull dot snap on the inseam strap 703 can be affixed to any one of a series of corresponding snaps 714 affixed to the litter element 100 so that the height of the seat support can be adjusted in relation to the surface of the litter according to the size of the casualty.

The portable transport system of the invention may also include an optional head restraint attachment to stabilize the neck and head of a casualty during movement. According to FIG. 22, a padded head band 138 is attached to the litter element by means of tension straps 143,144, which have sliding adjustable means, shown as tension buckles 145, 146 which allow for proper length adjustment of the tension straps. Each tension strap 143, 144 is attached to the head restraint band by means of a free running sliding buckle 142 connected to a loop 141. The free running movement of the buckles on either side of the head band allow for the correct tension positioning for each individual patient's head alignment. The free end of the tension strap is connected to the litter panel by means of a pull dot snap which may be fastened to a corresponding snap on the surface of the litter panel, such as the snaps used to fasten the pole restraint straps 128, 129. The tension straps may be affixed at varying positions to accommodate the patient's height. The head restraint is used in situations where a possible neck or spinal injury is suspected and the patient's head must be immobilized. The head band is comprised, for example, of a 1:1 rip stop nylon material with padding sewn inside. The diameter of the head band may be adjusted using VELCRO® reclosable hook and loop fastener areas 138, 139 sewn or otherwise attached onto opposing faces of the ends of the head band.

The portable transport system may be used in a number of other configurations to aid in rescue and casualty recovery.

Figure 9:
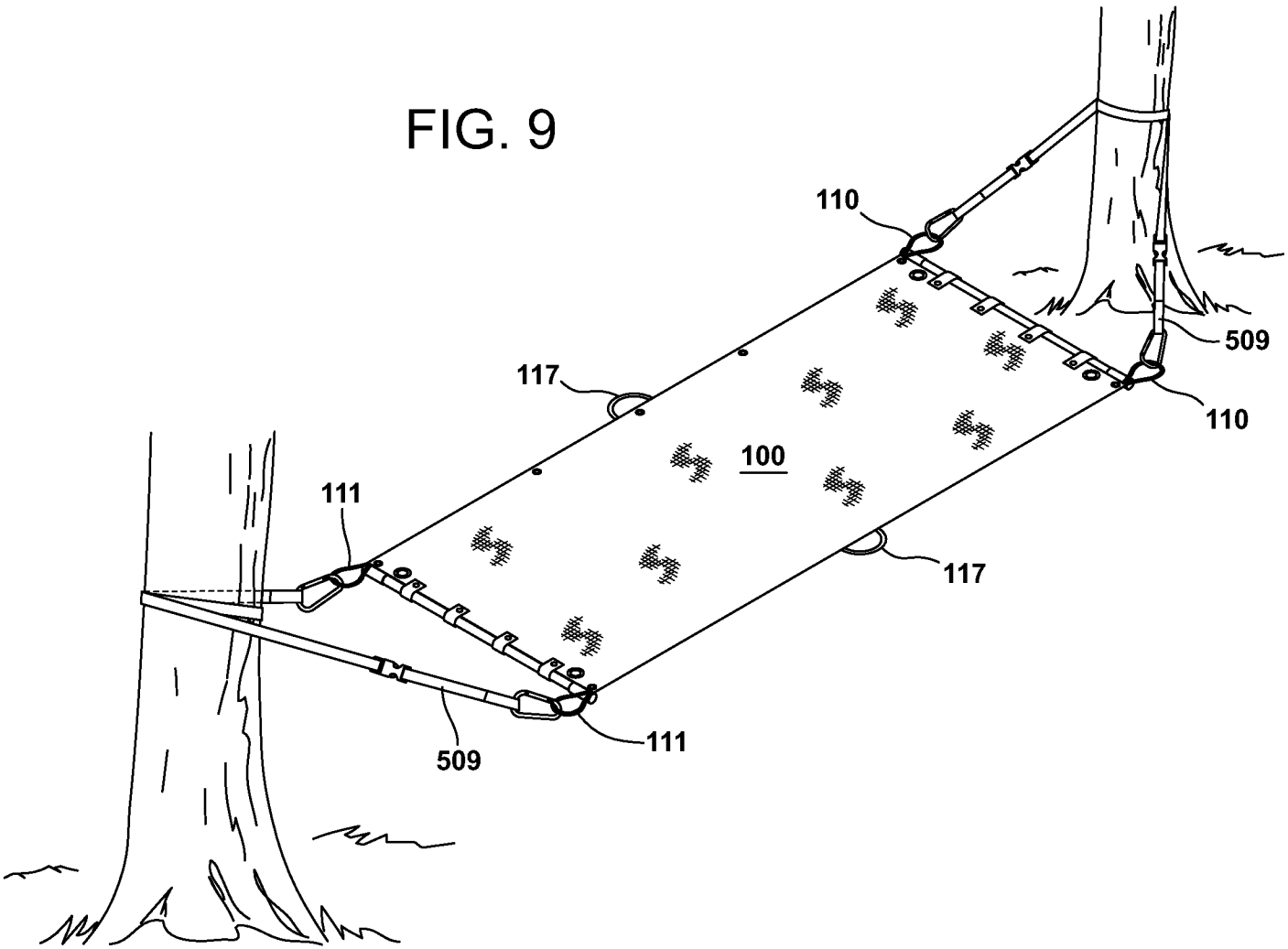
FIG. 9 shows an application of the invention used as a hammock.

In an embodiment according to FIG. 9, the litter element may be folded along its length and suspended as a hammock between two trees or vertical supports. The telescoping litter poles may be used as supports. In operation, each end of a cord or lanyard 509, for example a heavy duty nylon rope, is attached via a hook to a carry loop 110 at one end of the litter, then wrapped around the support by making one complete turn before it is fastened to the other carry loop at the same end of the litter. The carry loops 111 at the opposing end of the litter may be similarly attached.

In various other embodiments, the system may be configured into a lean-to shelter or pup tent as required. This is achieved by unfolding the litter panel into its full, unfolded dimensions (typically about 15 square feet). The unfolded litter panel may then be extended between two upright objects, such as trees, poles, etc., or if no such objects are available, between the telescoping poles used to support the sides of the litter in the casualty carrying position. In this respect, the poles may each have attached at one end thereof a tent stake attachment or spike that can be driven into the earth to maintain them in a vertical, erect position. Once the litter panel is extended between the upright supports, a cord or lanyard is strung between them to form a spine or center line to support the litter panel which is extended outward and downward over it to form the shelter. Where the litter panel touches the ground it is then staked or weighted down with stones or sandbags to hold it in place. Cords or lanyards may also be passed through the grommets located on the litter panel and strong at a downward angle and affixed to the earth by means of stakes, sticks or weights. In another assembly (not shown), one end panel of the litter element provides the base panel, i.e. the carrying surface on which the patient or casualty is laid, while the two contiguously aligned, adjacent panels (the center panel and the distal end panel) are folded and suspended over a tent cord that is horizontally positioned and secured at an appropriate height above the base panel.

Figure 10A:
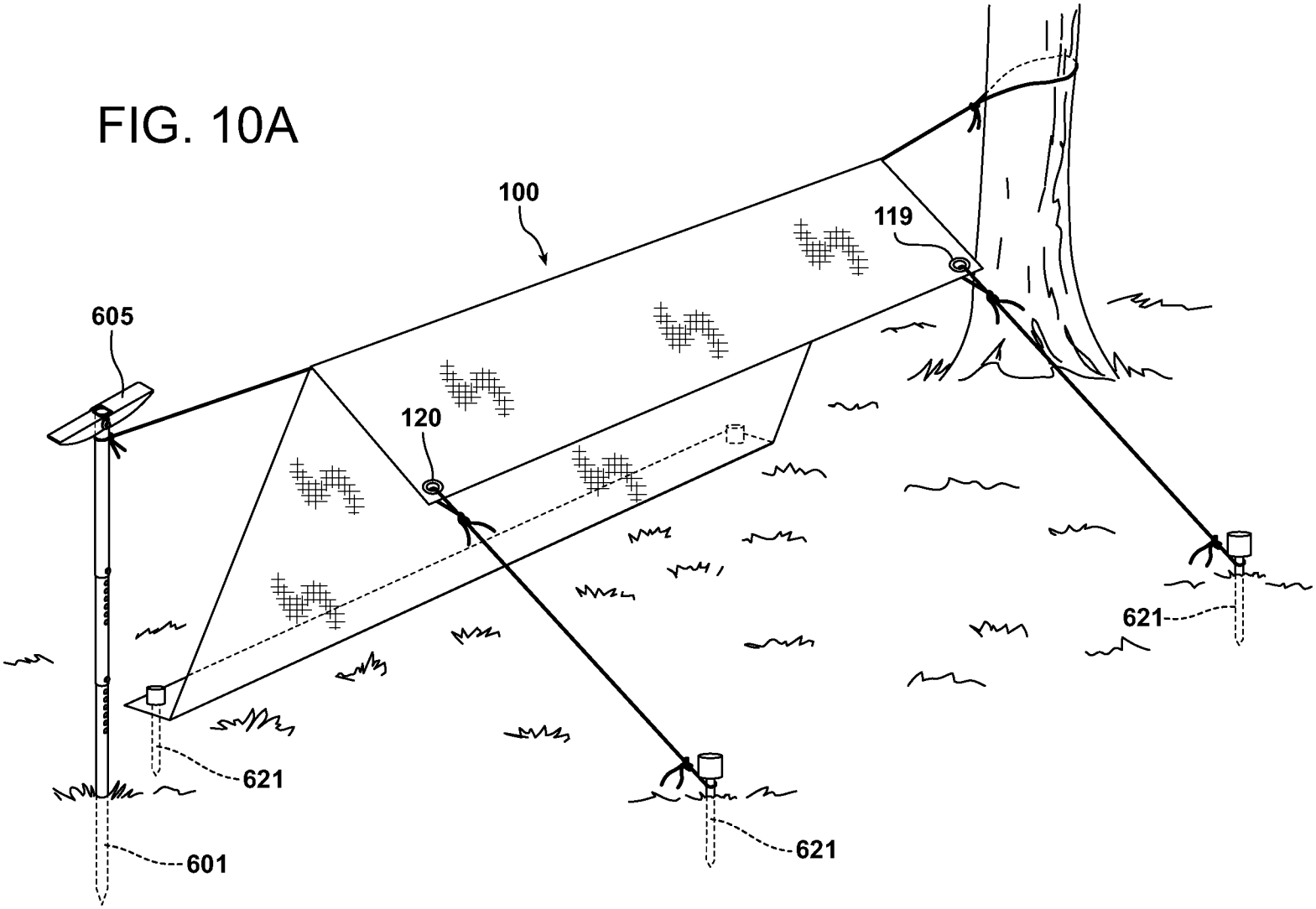
FIG. 10A shows an embodiment of the invention configured in a lean-to shelter arrangement.
Figure 10B:
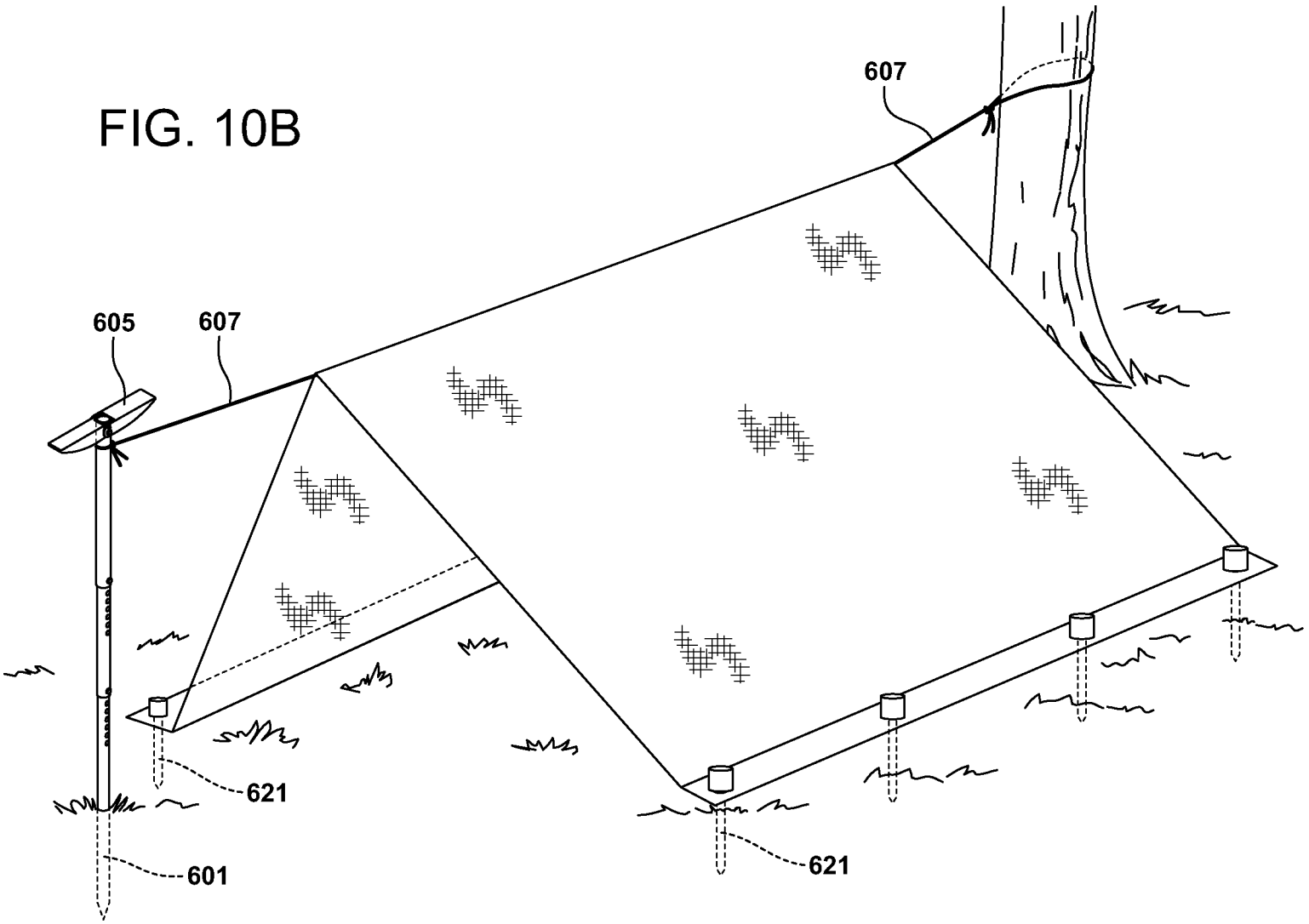
FIG. 10B shows an embodiment of the invention configured as a tent.

In the embodiment shown in FIG. 10A, the foldable litter element is erected over the patient or casualty as a lean-to. The tent cord is attached at either end to a support, such as a tree or pole, or to one of the telescoped litter poles which has been fitted with a spiked base plate 601 and inserted into the ground. the height of the tent may be elevated by elevating the tent cord and adjusting the fold line, then securing the shorter, free end of the folded distal end panel to the ground by cords attached at one end to the grommets 119 on one litter panel, and at the other end to tent pegs 621 that have been pounded into the ground. Mosquito netting or other camping accessories may be attached to the pup tent. In the configuration of FIG. 10B, the litter panel is equidistantly positioned over the tent cord as a pup tent so that the opposing sides of the litter panel may be staked to the ground. The method of erecting the pup tent is similar to that for the lean-to, except that the unfolded litter panel is approximately centered over the cord or lanyard to create an A-frame shelter with each side being staked or weighted to the earth. In a rescue situation the layered nature of the litter panel may be used to advantage for example by turning the blaze orange-colored layer outward. This increases the potential for search and rescue teams to spot the shelter configuration in hard to find locations.

When used in the lean-to or pup tent shelter configurations, mosquito netting may be attached to the opening areas of the shelter to protect the patient from insects or other pests.

In emergency situations where time is a factor in facilitating a rescue, the portable human transport system of the invention may be particularly used as a drag litter. In this embodiment the litter panel is long folded (along its length) but used without the telescoping poles or stabilizer bars in place. Even in this configuration a casualty may still be transported to safety. This is accomplished by placing the injured person onto the surface of the folded litter panel and securing the body with the casualty restraint straps, and optionally with the seat support system. Then, using the heavy duty carry loops as hand held drag handles, a single rescuer may drag and pull the casualty quickly from an area of personal danger. If there are two or more rescuers (up to as much as six), the other heavy duty loops may be grasped by these rescuers as hand-held carry handles. The multiple rescue personnel may then quickly lift and carry the casualty on the field-expedient litter system so created to a safe area. It should be noted this field-expedient carry system and method is recommended for use in situations where the risk of death supersedes the possible further injury of the person and where time is a critical issue, because unsupported transfer could exacerbate an existing injury. Once the casualty is safe from imminent danger the portable human transport system can be re-configured into one of the various transportation arrangements herein disclosed.

The portable human transport system may be stored with the implementation of a few simple steps. First, the telescoping poles (which can also be used as crutches) are collapsed and secured in the inward, folded position. In this respect, the tubular pole segments having the smaller diameters are inserted into those of larger diameter. The pole segments are then placed lengthwise along the short side (width) of the folded litter panel. If the litter panel unfolded measures about 90 inches square, the pole segments will be placed along the width measuring approximately 30 inches when the panel is long-folded. The litter panel is then rolled up along the 90 inch length. The rescue harness and the choke brake system are laid flat on top of each other and rolled up around the litter panel. The whole assembly is then inserted into a carrying container. The container is a tubular bag made of a fabric such as CORDURA® durable, high-tenacity fiber fabric, with a cylindrical diameter sufficient that attachments such as the travois wheels, harness attachments and other accessories may be placed in the bottom of the container. The rolled assembly is then inserted, after which any long attachments such as long tent stakes, sled drag attachments and travois sled elements are slipped in between the rolled layers and the sides of the container. The container itself is equipped with an adjustable strap, for example of webbed nylon, for cross body or shoulder carry. The exterior of the container is also sewn with pass-throughs via which the container may be attached to a backpack or other carrying system. It has a cylindrical closure with fasteners to secure the top opening.

In addition to its value in the military theater as an efficient rescue apparatus and support for first aid measures, the invention may be used in fire rescue and disaster search, rescue and recovery operations. The invention also finds applicability as a rescue device in the field of extreme sporting activities where injuries in remote locations are possible.

The foregoing description of specific embodiments is not intended to be limiting on the scope of this disclosure, but rather to be illustrative of the broad concepts embodied by this invention. Those skilled in the art will appreciate that the present invention contemplates the various embodiments of the invention herein described as well as equivalents thereof. However, those skilled in the art will also appreciate that the scope of this invention should be measured by the attached claims as well as by the specific embodiments identified.

The invention claimed is:

1. A portable human transport system comprising:

a. a frame for supporting a litter element, the frame further comprising two telescoping poles positioned parallel to each other to accommodate each side of the litter element, wherein each of the two poles is comprised of adjacently positioned segments which are insertably related one to the other in series such that all or a portion of each segment in the series may be inserted into or withdrawn from the next segment in series to form a telescopically extended pole that may be withdrawn and locked in place to provide an extended pole length that fully accommodates the edge of the litter element, or each segment in the series may be inserted into the next adjacent segment in series to collapse and reduce the overall length of the pole;

b. a litter element comprising one or more adjacently located, folded panels, each of which may be attached and/or folded at an angle in relation to the other; and one or more carry loops; and further wherein the litter element further includes means for securing the telescoping poles to the litter element;

c. at least one rescue harness for securing the litter element to the front or back of one or more rescuers; and d. a choke brake system removably connected to each rescue harness comprising a movable bezel ring that arrests forward and rear oscillation and movement of the system when it is attached to the at least one rescue harness and the litter element;

wherein the portable human transport system may be compactly folded for storage and transport; and further wherein the configuration of the portable human transport system allows for its transport and operation by a single user to transport a casualty or to provide a temporary shelter; and further wherein the system is convertible between the field stretcher, an aerial lift assembly, hammock, lean-to or tent.

2. The system of claim 1 wherein the attachment means for securing the telescoping poles to the litter element is selected from one or more pole sleeves spatially located along the long fold sides of the litter element; one or more straps which may be reversibly attached to the surface of the litter element to form loops through which the telescoping poles may be inserted; or a combination of straps and pole sleeves.

3. The system of claim 2 wherein the straps are attached to the surface of the litter element by pairs of pull dot snaps, wherein one of a pair of pull dot snaps is located on the end of each one or more strap and the corresponding pull dot snap is located on the surface of the litter element; or alternatively, the straps are attached by hook and loop fastener tape closures wherein a male or female hook and loop fastener tape tab is located at the end of each one or more strap and the corresponding hook and loop fastener tape tab is located on the surface of the litter element.

4. The system of claim 1 further comprising one or more stabilizer bars that are attached at the head and/or tail end of the litter element in a position approximately perpendicular to the telescoping poles.

5. The system of claim 1 wherein the folded panels are comprised of one or more layers of materials selected from the group consisting of durable, high-tenacity fiber fabric, nylon, canvas, plastics, rubber, nonstick polytetrafluoroethylene-coated fabric, high-strength, wholly aromatic polyamide fabric and combinations thereof.

6. The system of claim 1 wherein the litter element is comprised of a single panel folded into three panels.

7. The system of claim 6 wherein the folded panels includes one or more series of fasteners on the uppermost layer of the folded panels; and one or more series of fasteners on the lower layers of the folded panels; wherein the series of fasteners on the uppermost and lower layers connect to secure the folds between the panels.

8. The system of claim 1 wherein the telescoping poles have movable handles, which, when extended, configure the poles for use as crutches or walking sticks.

9. The system of claim 1 further comprising an aerial lift assembly.

10. The system of claim 1 further comprising a seat support.

11. The system of claim further comprising a head restraint system.

12. The system of claim 1 further comprising a lift assembly for aerial lift.

13. A portable human transport system comprising:

a. a litter element comprising one or more adjacently located, folded panels, each of which may be attached to each other and folded at an angle in relation to the other; two or more carry loops; and casualty restraint straps for securing the body of a casualty to the surface of the litter element;

b. at least one rescue harness for securing the litter element to the front or back of one or more rescuers; and c. a choke brake system removably connected to each rescue harness comprising a movable bezel ring that arrests forward and rear oscillation and movement of the system when it is attached to the at least one rescue harness, and which comprises straps that attach to the rescue harness and to the litter element.

14. The system of claim 13 wherein the litter element is further folded and attached to the rear of a rescue harness to form a seat for carrying a casualty in a seated position.

15. A method of transporting a casualty comprising:

a. placing the body of the casualty on a litter element comprising one or more adjacently located, folded panels, each of which may be attached to each other and folded at an angle in relation to the other; and one or more casualty restraint straps;

b. securing the casualty restraint straps about the body of the casualty;

c. attaching at least one end of the litter to one end of a choke brake system that is removably connected to the rescue harness, comprising a movable bezel ring that arrests forward and rear oscillation and movement of the system when it is attached to the rescue harness and the litter element;

d. attaching the other end of the choke brake system to the front or rear shoulder straps of a rescue harness worn by a rescuer; and e. by means of the rescuer's movement transporting the casualty to safety.

16. The method of claim 15 which further includes assembling a pair of telescoping poles to form a frame for the sides of the litter; and optionally attaching one or more stabilizer restraint bars at the head and/or tail end of the litter.

17. The method of claim 16 further comprising attaching an aerial lift assembly for air transport.

* * * * *

UNITED STATES PATENT AND TRADEMARK OFFICE

CERTIFICATE OF CORRECTION

PATENT NO. : 9,044,364 B2
APPLICATION NO. : 13/943768
DATED : June 2, 2015
INVENTOR(S) : D. Dominick It is certified that error appears in the above-identified patent and that said Letters Patent is hereby corrected as shown below:

In the claims

Col. 19, Claim 11, line 30, should read as follows:

11. (Corrected) The system of claim 1 further comprising a head restraint system.

Signed and Sealed this
Thirteenth Day of October, 2015

Michelle K. Lee

Michelle K. Lee
*Director of the United States Patent and Trademark Office*